US012351359B1

(12) United States Patent
D'Andrea

(10) Patent No.: US 12,351,359 B1
(45) Date of Patent: Jul. 8, 2025

(54) ENHANCED CARDBOARD-BASED PALLET SYSTEM

(71) Applicant: American Paper Pallet Company LLC, Perris, CA (US)

(72) Inventor: Sergio D'Andrea, Duluth, GA (US)

(73) Assignee: American Paper Pallet Company LLC, Perris, CA (US)

( * ) Notice: Subject to any disclaimer, the term of this patent is extended or adjusted under 35 U.S.C. 154(b) by 0 days.

(21) Appl. No.: 18/969,282

(22) Filed: Dec. 5, 2024

(51) Int. Cl.
*B65D 19/00* (2006.01)

(52) U.S. Cl.
CPC ..... *B65D 19/0069* (2013.01); *B65D 2519/00019* (2013.01); *B65D 2519/00054* (2013.01)

(58) Field of Classification Search
CPC ..... B65D 19/002; B65D 19/0024; B65D 19/0026; B65D 19/0042; B65D 19/0069; B65D 19/06; B65D 19/20; B65D 2519/00019; B65D 2519/00054; B65D 2519/00089
USPC ..... 108/51.3, 57.18
See application file for complete search history.

(56) References Cited

U.S. PATENT DOCUMENTS

| | | | | | |
|---|---|---|---|---|---|
| 4,979,446 | A * | 12/1990 | Winebarger | B65D 19/0026 | 108/56.1 |
| 5,487,345 | A * | 1/1996 | Winebarger | B65D 19/0024 | 108/56.1 |
| 7,905,183 | B2 * | 3/2011 | Gibson | B65D 19/385 | 206/386 |
| 8,113,129 | B1 * | 2/2012 | Hurley | B65D 19/0028 | 108/56.3 |
| 2008/0295747 | A1 * | 12/2008 | Vinderola | B65D 19/0028 | 108/51.3 |
| 2012/0204767 | A1 * | 8/2012 | Jian | B65D 19/0028 | 108/51.3 |
| 2017/0015463 | A1 * | 1/2017 | Gabrys | B65D 19/44 | |
| 2018/0244430 | A1 * | 8/2018 | Berkes | B65D 19/0073 | |
| 2019/0144162 | A1 * | 5/2019 | Burden | B32B 1/00 | 248/346.02 |
| 2024/0246721 | A1 * | 7/2024 | Langen | B65D 19/0026 | |

* cited by examiner

*Primary Examiner* — Daniel J Rohrhoff
(74) *Attorney, Agent, or Firm* — Grandview Law

(57) ABSTRACT

A pallet system includes first bent cardboard sheets with sheet portions, first apertures, second apertures, and with bends that place the sheet portions in juxtaposition thereby forming first beam members with engagement notches and forklift blade access cutouts. Second beam members are similarly formed to couple with the first beam members resulting in a base assembly for a pallet system. Other aspects are described in the claims, drawings, and text forming a part of the present disclosure.

20 Claims, 35 Drawing Sheets

ENHANCED CARDBOARD-BASED PALLET SYSTEM

SUMMARY

In one or more aspects a pallet system includes (I) a first cardboard sheet having a first sheet thickness measurement, the first cardboard sheet including (A) a first sheet side, (B) a second sheet side extending perpendicularly to the first side, (C) a third sheet side extending parallel to the first side, (D) a fourth sheet side extending parallel to the second side, and (E) a plurality of demarcated bend lines extending parallel to the first sheet side and to the third sheet side, wherein each of the plurality of demarcated bend lines extends between the second sheet side and the fourth sheet side, wherein the plurality of demarcated bend lines includes a first demarcated bend line, a second demarcated bend line, a third demarcated bend line, and a fourth demarcated bend line, wherein the first demarcated bend line is closest of the plurality of demarcated bend lines to the third sheet side and is at least ten times the first sheet thickness measurement from the third sheet side, wherein the second demarcated bend line is second closest of the plurality of demarcated bend lines to the third sheet side and is less than three times the first sheet thickness measurement from the first demarcated bend line; wherein the third demarcated bend line is third closest of the plurality of demarcated bend lines to the third sheet side and is at least twenty-five times the first sheet thickness measurement from the third sheet side, and wherein the fourth demarcated bend line is fourth closest of the plurality of demarcated bend lines to the third sheet side being less than five times the first sheet thickness measurement from the third demarcated bend line and being farther from the third demarcated bend line than the second demarcated bend line is from the first demarcated bend line.

Implementations further include a first plurality of apertures with first and third side portions extending parallel with the first sheet side, and with second and fourth side portions extending parallel with the second sheet side, wherein the first plurality of apertures includes a first aperture, and a second aperture, wherein the first and third side portions of the first aperture are equal to the first and third side portions of the second aperture, respectively, and wherein the fourth side portion of the first aperture and the fourth side portion of the second aperture are equally spaced from the fourth sheet side.

In implementations a first portion of the second side portion of the first aperture extends a first length perpendicularly from the first demarcated bend line to the third side portion of the first aperture, wherein a second portion of the second side portion of the first aperture extends a second length perpendicularly from the second demarcated bend line to the first side portion of the first aperture, and wherein the first length equals the second length.

In implementations the first and third side portions of the first plurality of apertures have lengths at least twenty times the first sheet thickness measurement, and wherein the second and fourth side portions of the first plurality of apertures have lengths at least ten times the first sheet thickness measurement.

In implementations the second and fourth side portions of the first aperture are smaller than the second and fourth side portions of the second aperture, respectively.

In implementations the first plurality of apertures includes a third aperture, and a fourth aperture, wherein the first and third side portions of the third aperture are equal to the first and third side portions of the fourth aperture, respectively, wherein the fourth side portion of the third aperture and the fourth side portion of the fourth aperture are equally spaced from the fourth sheet side, wherein the fourth side portion of the third aperture and the fourth side portion of the second aperture are unequally spaced from the fourth sheet side, wherein the third side portions of the first aperture and the third aperture are equally spaced from the third sheet side, and wherein the third side portions of the second aperture and the fourth aperture are equally spaced from the third sheet side.

Implementations further include a second plurality of apertures with first and third side portions extending parallel with the first sheet side, and with second and fourth side portions extending parallel with the second sheet side, wherein the second plurality of apertures includes a first aperture and a second aperture, wherein the first and third side portions of the first aperture of the second plurality of apertures are equal to the first and third side portions of the second aperture of the second plurality of apertures, respectively, wherein the first and third side portions of the first aperture of the second plurality of apertures are not equal to the first and third side portions of the first aperture of the first plurality of apertures, respectively, wherein the second and fourth side portions of the first aperture of the second plurality of apertures are not equal to the second and fourth side portions of the first aperture of the first plurality of apertures, respectively, wherein the third side portion of the first aperture of the second plurality of apertures and the third side portion of the second aperture of the second plurality of apertures are unequally spaced from the third sheet side, and wherein the fourth side portion of the first aperture of the second plurality of apertures and the fourth side portion of the second aperture of the second plurality of apertures are equally spaced from the fourth sheet side.

In implementations a first portion of the second side portion of the first aperture of the second plurality of apertures extends a first length perpendicularly from the third demarcated bend line to the third side portion of the first aperture of the second plurality of apertures, wherein a second portion of the second side portion of the first aperture extends a second length perpendicularly from the fourth demarcated bend line to the first side portion of the first aperture of the second plurality of apertures, and wherein the first length equals the second length.

In implementations the first and third side portions of the second plurality of apertures have lengths at least four times the first sheet thickness measurement, and wherein the second and fourth side portions of the second plurality of apertures have lengths at least ten times the first sheet thickness measurement.

In implementations the second and fourth side portions of the first aperture of the second plurality of apertures are smaller than the second and fourth side portions of the second aperture of the second plurality of apertures, respectively.

Implementations further include a plurality of square-notch portions with first side portions extending parallel with the first sheet side, and with second and third side portions extending parallel with the second sheet side, wherein at least one of the plurality of square-notch portions has the second and third side portions extending from the first sheet side, and wherein at least one of the plurality of square-notch portions has the second and third side portions extending from the third sheet side.

Implementations further include (II) a second cardboard sheet having a second sheet thickness measurement, the first cardboard sheet including (A) a first sheet side, (B) a second sheet side extending perpendicularly to the first side, (C) a third sheet side extending parallel to the first side, (D) a fourth sheet side extending parallel to the second side, and (E) a plurality of demarcated bend lines extending parallel to the first sheet side and to the third sheet side, (F) a first plurality of apertures with first and third side portions extending parallel to the third sheet side, and with second and fourth side portions extending parallel to the second sheet side, (G) a second plurality of apertures with first and third side portions extending parallel to the third sheet side, and with second and fourth side portions extending parallel to the second sheet side, wherein the first and third side portions of the first plurality of apertures have a first length, wherein the first and third side portions of the second plurality of apertures have a second length, wherein the first length does not equal the second length, wherein each of the plurality of demarcated bend lines extends between the second sheet side and the fourth sheet side, wherein the plurality of demarcated bend lines includes a first demarcated bend line, and a second demarcated bend line, wherein the first demarcated bend line is closest of the plurality of demarcated bend lines to the third sheet side, and wherein the second demarcated bend line is second closest of the plurality of demarcated bend lines to the third sheet side.

In implementations a first portion of the second side portion of a first aperture of the first plurality of apertures of the second cardboard sheet extends a first length perpendicularly from the first demarcated bend line of the second cardboard sheet to the third side portion of the first aperture of the first plurality of apertures of the second cardboard sheet, wherein a second portion of the second side portion of the first aperture of the first plurality of apertures of the second cardboard sheet extends a second length perpendicularly from the second demarcated bend line of the second cardboard sheet to the first side portion of the first aperture of the first plurality of apertures of the second cardboard sheet, wherein the first length equals the second length, wherein a first portion of the second side portion of a first aperture of the second plurality of apertures of the second cardboard sheet extends a third length perpendicularly from the first demarcated bend line to the third side portion of the first aperture of the second plurality of apertures of the second cardboard sheet, wherein a second portion of the second side portion of the first aperture of the second plurality of apertures of the second cardboard sheet extends a fourth length perpendicularly from the second demarcated bend line to the first side portion of the first aperture of the second plurality of apertures of the second cardboard sheet, wherein the third length equals the fourth length, and wherein the first length is unequal to the third length.

In implementations the plurality of demarcated bend lines totals an "n" numbered amount, wherein the "n" number is an even number, wherein the first cardboard sheet is bent at each of the plurality of demarcated bend lines such that "n+1" cardboard sheet portions are positioned parallel with one another including a first cardboard sheet portion bordered by the third sheet side and bordered by the first demarcated bend line, a second cardboard sheet portion bordered by the second demarcated bend line and bordered by the third demarcated bend line, and an "n+1" cardboard sheet portion bordered by a demarcated bend line closest to the first sheet side and bordered by the first sheet side, whereby the first cardboard sheet forms a first longitudinal beam member having first and second longitudinal sides and having first and second ends perpendicular to the first and second longitudinal sides, and wherein the first longitudinal beam member includes at least one engagement notch along the first longitudinal side.

In implementations the first longitudinal beam member includes the at least one forklift blade access cutout along the second longitudinal side, and wherein the plurality of demarcated bend lines include at least one form taken from the forms of perforated lines, creased lines, and printed lines.

In implementations the first longitudinal beam member includes the at least one forklift blade access cutout along the first longitudinal side, and wherein the plurality of demarcated bend lines include at least one form taken from the following forms of perforated lines, creased lines, and printed lines.

In implementations the first cardboard sheet is bent at each of the plurality of demarcated bend lines to form a first longitudinal beam member having first and second longitudinal sides and having first and second ends perpendicular to the first and second longitudinal sides, wherein the first longitudinal beam member includes at least one engagement notch along the first longitudinal side, and wherein the first longitudinal beam member includes at least one forklift blade access cutout along the second longitudinal side.

In implementations the second cardboard sheet includes a plurality of demarcated bend lines, wherein the second cardboard sheet is bent at each of the demarcated bend lines to form a second longitudinal beam member having first and second longitudinal sides and having first and second ends perpendicular to the first and second longitudinal sides, wherein the second longitudinal beam member includes at least one engagement notch along the first longitudinal side, wherein the second longitudinal beam member includes at least one forklift blade access cutout along the first longitudinal side, wherein the at least one engagement notch of the second longitudinal beam member is couplable with the at least one engagement notch of the first longitudinal beam.

In one or more aspects a pallet system includes (I) a bent cardboard sheet having a sheet thickness measurement, the first cardboard sheet including (A) a first sheet side, (B) a second sheet side extending perpendicularly to the first side, (C) a third sheet side extending parallel to the first side, (D) a fourth sheet side extending parallel to the second side, (E) a first plurality of apertures having rectangularly oriented side portions, (F) a second plurality of apertures having rectangularly oriented side portions, wherein the side portions of the first plurality of apertures are proportionally shaped different than the side portions of the second plurality of apertures, and (F) a plurality of demarcated bend lines extending parallel to the first sheet side and to the third sheet side, wherein each of the plurality of demarcated bend lines extends between the second sheet side and the fourth sheet side, wherein pairs of the plurality of demarcated bend lines are spaced from one another according to the sheet thickness measurement, wherein the plurality of demarcated bend lines includes a first demarcated bend line closest to the third sheet side, a second demarcated bend line second closest to the third sheet side, a third demarcated bend line third closest to the third sheet side, wherein the plurality of demarcated bend lines totals an "n" numbered amount, wherein the first cardboard sheet is bent at each of the plurality of demarcated bend lines such that "n+1" cardboard sheet portions are positioned parallel with one another including a first cardboard sheet portion bordered by the third sheet side and bordered by the first demarcated bend line, a second cardboard sheet portion bordered by the second demarcated bend line and bordered by the third demarcated bend line, and an "n+1" cardboard sheet portion bordered by a demarcated bend line closest to the first sheet side and bordered by the first sheet side, whereby the bent cardboard sheet forms a first longitudinal beam member having first and second longitudinal sides and having first and second ends perpendicular to the first and second longitudinal sides, and wherein the first longitudinal beam member includes at least one engagement notch formed from at least in part the first plurality of apertures along the first longitudinal side, wherein the first longitudinal beam member includes at least one forklift blade access cutout formed at least in part from the second plurality of apertures along one of the first longitudinal side and the second longitudinal side.

In one or more aspects a pallet system includes (I) a first bent cardboard sheet including (A) a plurality of cardboard sheet portions, (B) a first plurality of apertures, (C) a second plurality of apertures, wherein the first bent cardboard sheet has a plurality of bends such that the plurality of cardboard sheet portions are in juxtaposition and with adhesive positioned therebetween, whereby the first bent cardboard sheet forms a first longitudinal beam member having first and second longitudinal sides, wherein the first longitudinal beam member includes at least one engagement notch formed from at least in part the first plurality of apertures along the first longitudinal side, and wherein the first longitudinal beam member includes at least one forklift blade access cutout formed at least in part from the second plurality of apertures along the second longitudinal side; and (II) a second bent cardboard sheet including (A) a plurality of cardboard sheet portions, (B) a first plurality of apertures, (C) a second plurality of apertures, wherein the first bent cardboard sheet has a plurality of bends such that the plurality of cardboard sheet portions are in juxtaposition and with adhesive positioned therebetween, whereby the second bent cardboard sheet forms a second longitudinal beam member having first and second longitudinal sides, wherein the second longitudinal beam member includes at least one engagement notch formed from at least in part the first plurality of apertures along the first longitudinal side, wherein the second longitudinal beam member includes at least one forklift blade access cutout formed at least in part from the second plurality of apertures along the first longitudinal side, and wherein the at least one engagement notch of the first longitudinal beam member is couplable with the at least one engagement notch of the second longitudinal beam member.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Enhanced Cardboard-Based Pallet System, articles of manufacture, compositions of matter for same that may provide context, for instance, in introducing one or more processes and/or devices described herein.

DETAILED DESCRIPTION

Figure 1:
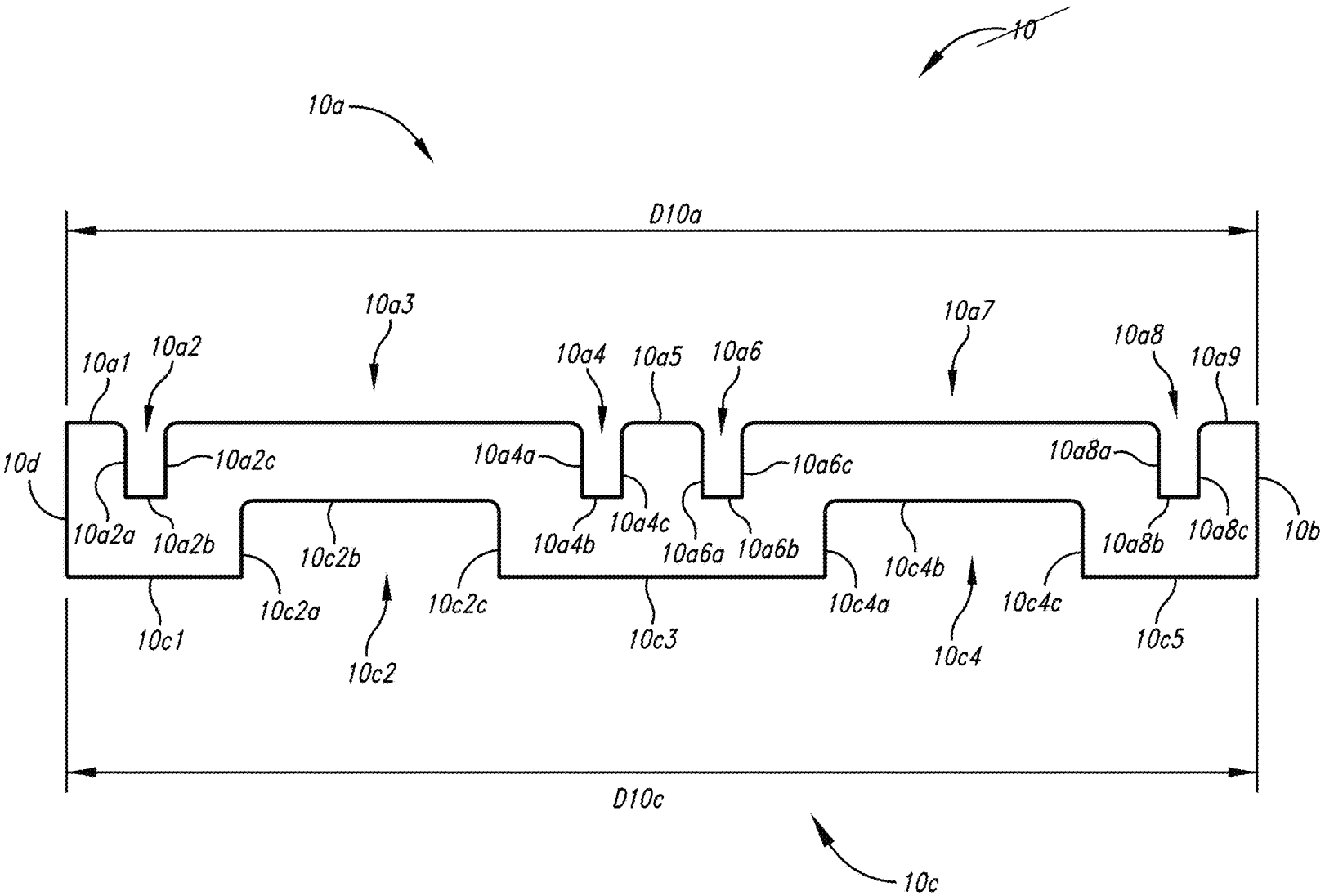
FIG. 1 is a side elevation view of a lower beam member.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a side elevation view of lower beam member 10, which is the bent configuration of configured lower cardboard sheet 20 discussed below. In implementations corrugated cardboard can be sourced in various forms such as virgin, recycled, biodegradable, and/or international phytosanitary standards compliant corrugated cardboard. In its unassembled state, implementations have space requirements that are one-third that of its assembled state shown further below.

In implementations lower beam member 10 includes beam side 10*a*, beam side 10*b*, beam side 10*c*, and beam side 10*d*. In implementations beam side 10*a* includes side portion 10*a*1, engagement notch 10*a*2, side portion 10*a*3, engagement notch 10*a*4, side portion 10*a*5, engagement notch 10*a*6, side portion 10*a*7, engagement notch 10*a*8, and side portion 10*a*9. In implementations lower beam member 10 includes side dimension D10*a* (such as for example 1200 mm).

In implementations beam side 10*a* includes notch side 10*a*2*a*, notch side 10*a*2*b*, and notch side 10*a*2*c*. In implementations engagement notch 10*a*4 includes notch side 10*a*4*a*, notch side 10*a*4*b*, and notch side 10*a*4*c*. In implementations engagement notch 10*a*6 includes notch side 10*a*6*a*, notch side 10*a*6*b*, and notch side 10*a*6*c*. In implementations engagement notch 10*a*8 includes notch side 10*a*8*a*, notch side 10*a*8*b*, and notch side 10*a*8*c*.

In implementations beam side 10*c* includes side portion 10*c*1, forklift blade access cutout 10*c*2, side portion 10*c*3, and forklift blade access cutout 10*c*4. In implementations beam side 10*c* includes side dimension D10*c* (such as for example 1200 mm). In implementations forklift blade access cutout 10*c*2 includes access side 10*c*2*a*, access side 10*c*2*b*, and access side 10*c*2*c* to accommodate insertion of a forklift blade (such as having a blade width for example of three or more inches in width) when configured as part of a pallet to hold up for example eight static tons. In implementations forklift blade access cutout 10*c*4 includes access side 10*c*4*a*, access side 10*c*4*b*, access side 10*c*4*c*, and side portion 10*c*5.

Figure 1A:
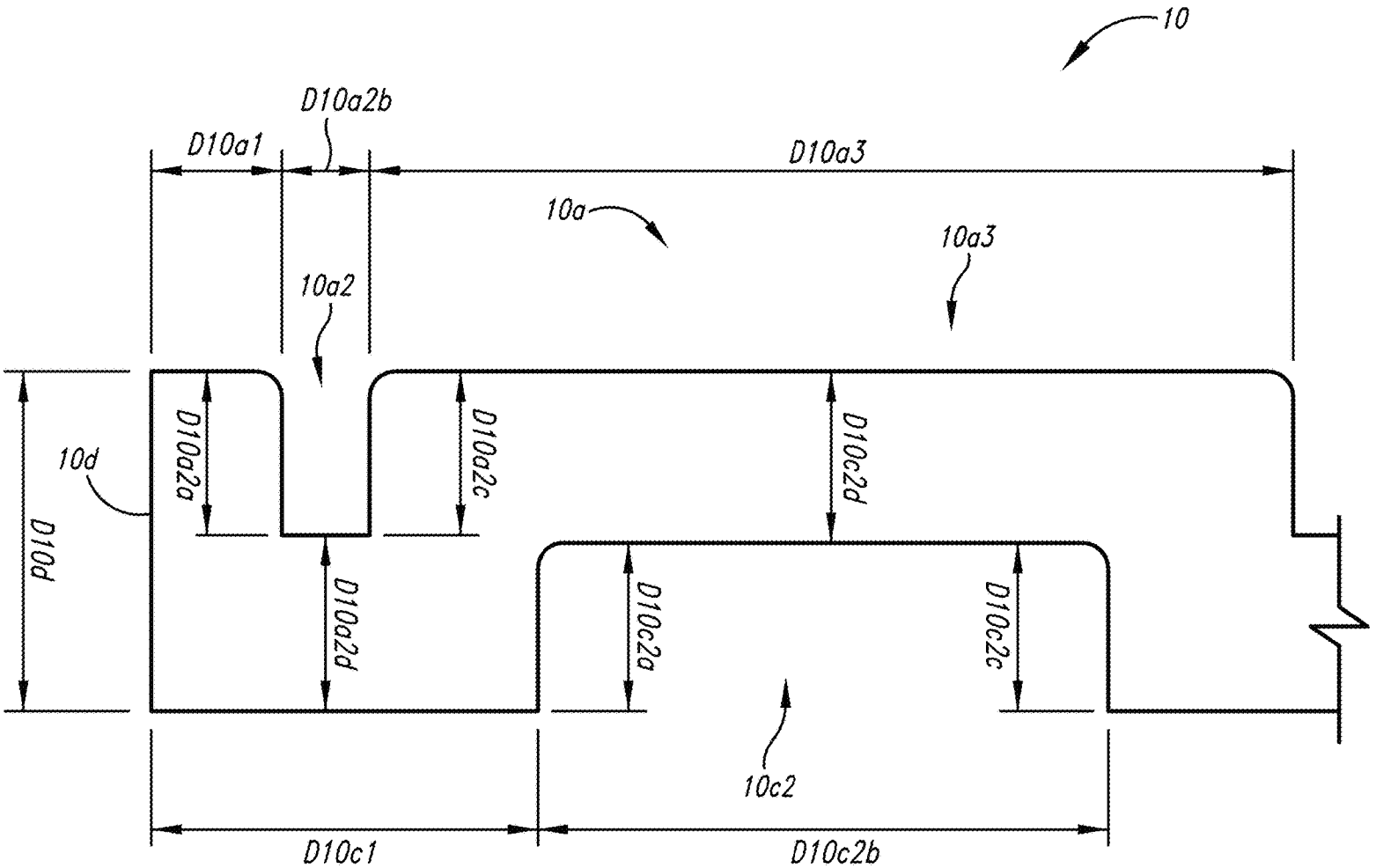
FIG. 1A is a side elevation view of a portion of the lower beam member of FIG. 1.

Turning to FIG. 1A, depicted therein is a side elevation view of a portion of lower beam member 10. In implementations beam side 10*a* includes side portion dimension D10*a*1, and side portion dimension D10*a*3. In implementations engagement notch 10*a*2 includes notch side dimension D10*a*2*a*, notch side dimension D10*a*2*b* (such as for example 37 mm), notch side dimension D10*a*2*c*, and spacing dimension D10*a*2*d*.

In implementations beam side 10*c* includes side portion dimension D10*c*1. In implementations forklift blade access cutout 10*c*2 includes access side dimension D10*c*2*a*, access side dimension D10*c*2*b* (such as for example 260 mm), access side dimension D10*c*2*c*, and spacing dimension D10*c*2*d*.

Figure 1B:
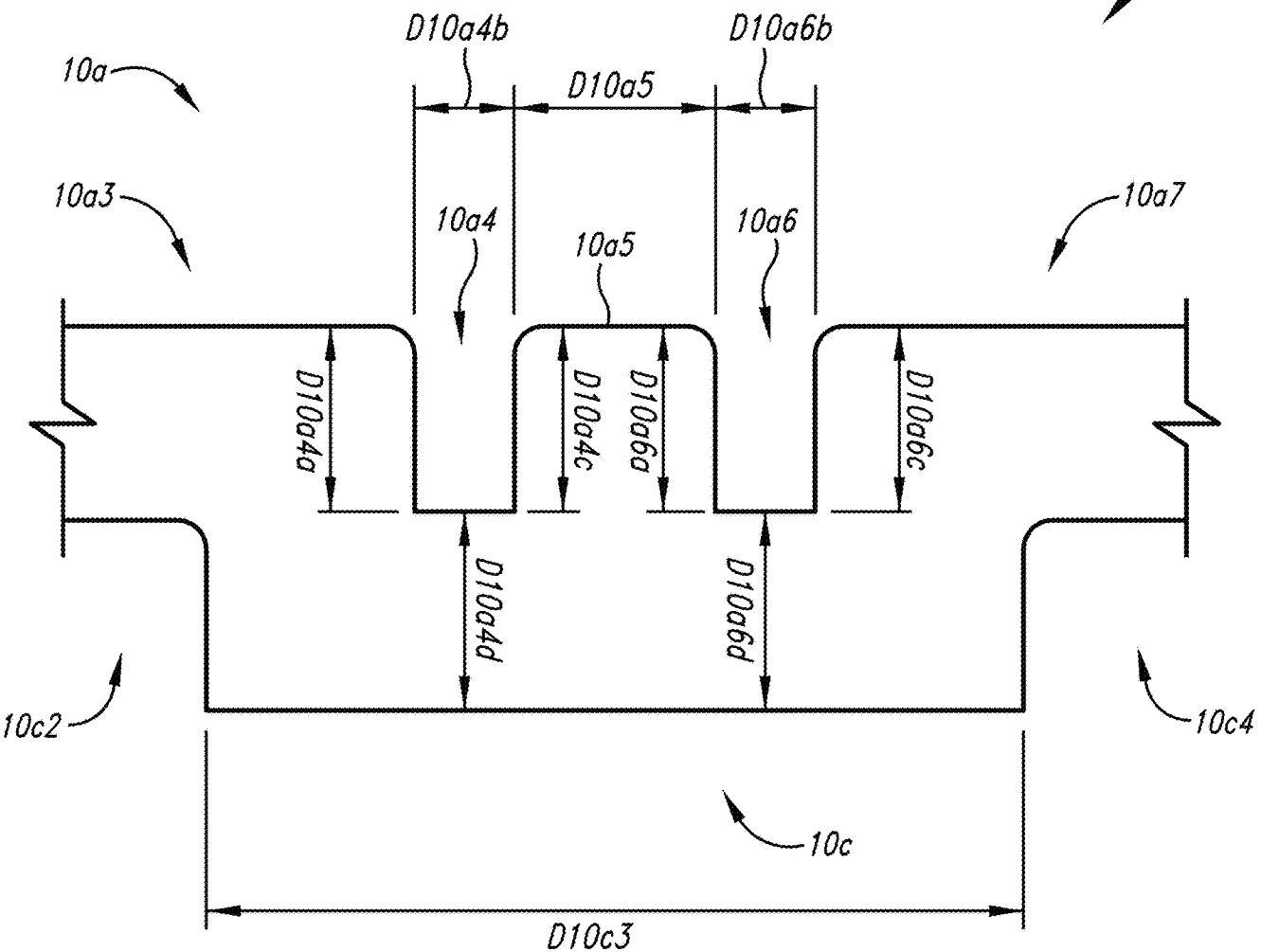
FIG. 1B is a side elevation view of a portion of the lower beam member of FIG. 1.

Turning to FIG. 1B, depicted therein is a side elevation view of a portion of lower beam member 10. In implementations engagement notch 10*a*4 includes notch side dimension D10*a*4*a*, notch side dimension D10*a*4*b*, notch side dimension D10*a*4*c*, and spacing dimension D10*a*4*d*. In implementations beam side 10*a* includes side portion dimension D10*a*5. In implementations engagement notch 10*a*6 includes notch side dimension D10*a*6*a*, notch side dimension D10*a*6*b*, notch side dimension D10*a*6*c*, and spacing dimension D10*a*6*d*. In implementations beam side 10*c* includes side portion dimension D10*c*3.

Figure 1C:
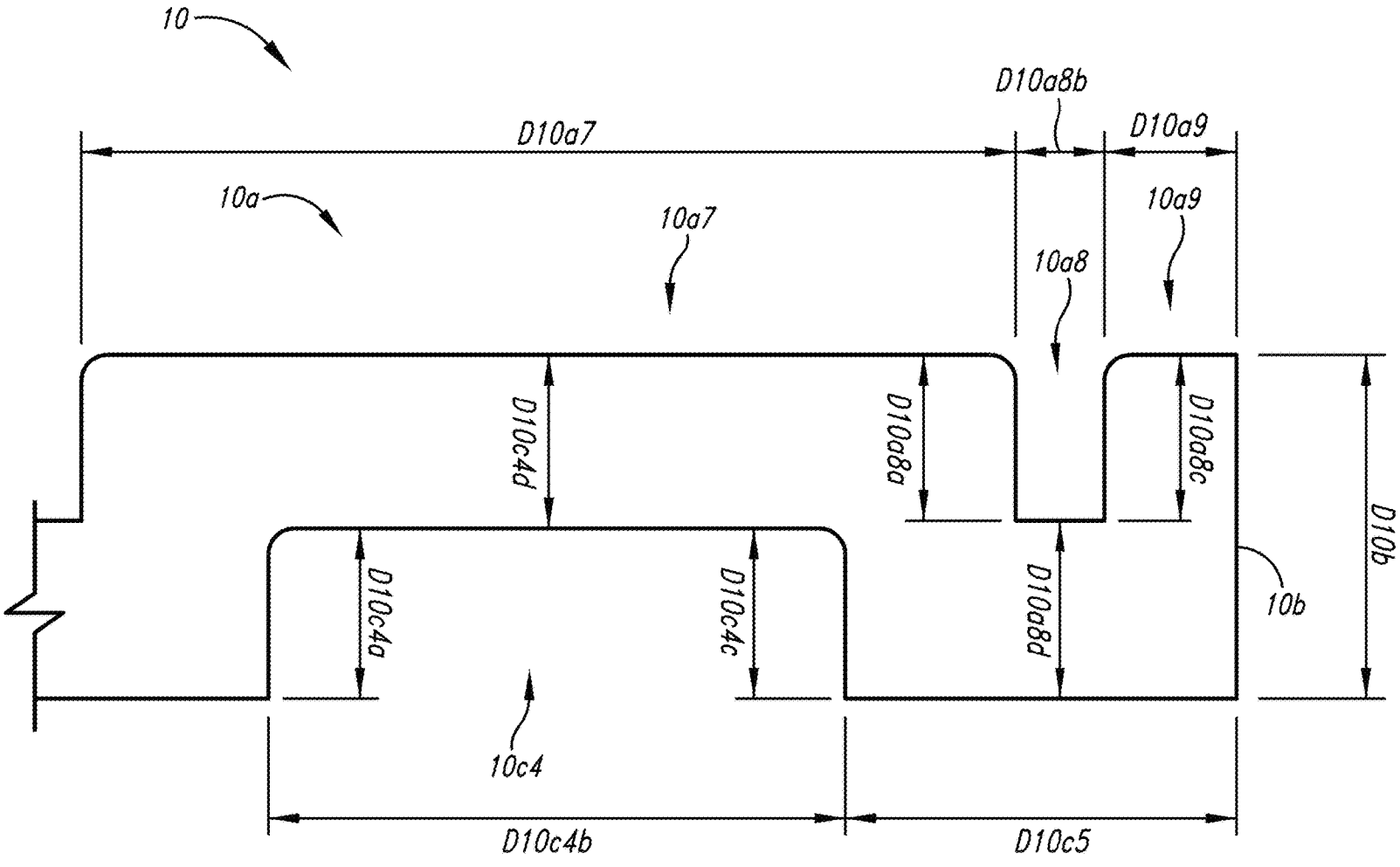
FIG. 1C is a side elevation view of a portion of the lower beam member of FIG. 1.

Turning to FIG. 1C, depicted therein is a side elevation view of a portion of lower beam member 10. In implementations beam side 10*a* includes side portion dimension D10*a*7, and side portion dimension D10*a*9. In implementations engagement notch 10*a*8 includes notch side dimension D10*a*8*a*, notch side dimension D10*a*8*b*, notch side dimension D10*a*8*c*, and spacing dimension D10*a*8*d*.

In implementations lower beam member 10 includes side dimension D10*b*. In implementations forklift blade access cutout 10*c*4 includes access side dimension D10*c*4*a*, access side dimension D10*c*4*b*, access side dimension D10*c*4*c*, and spacing dimension D10*c*4*d*. In implementations beam side 10*c* includes side portion dimension D10*c*5.

Figure 2:
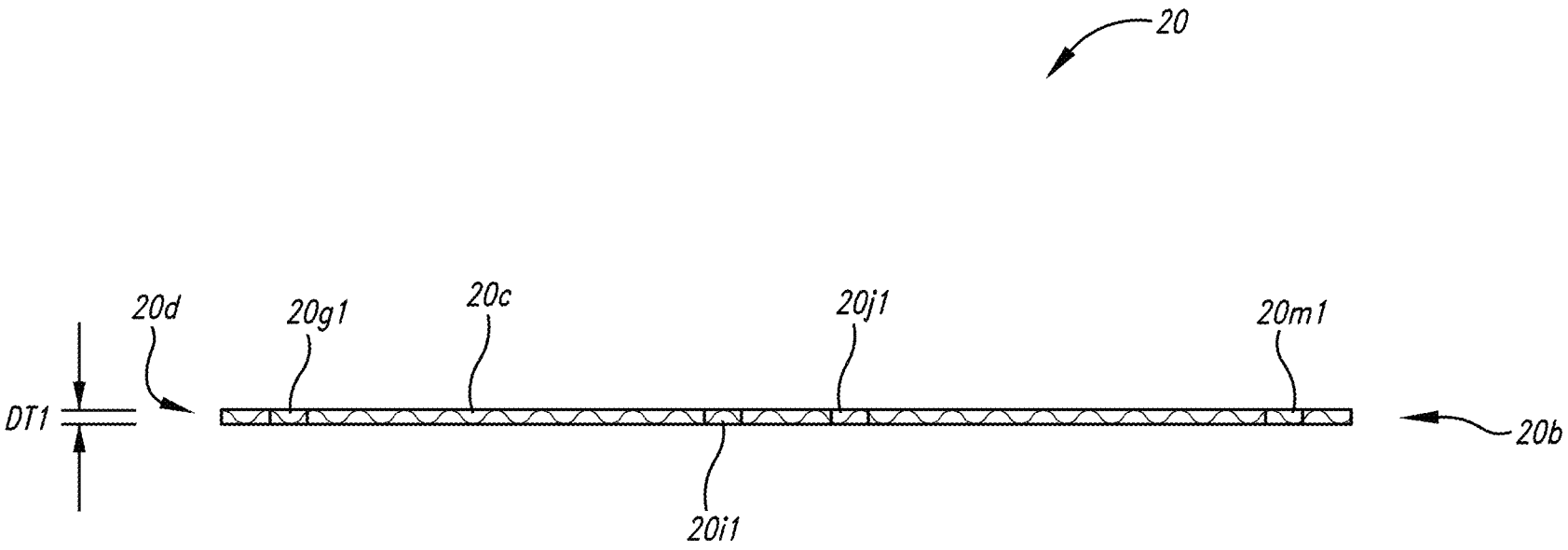
FIG. 2 is an side elevation end view of an unfolded configured lower sheet for the lower beam member of FIG. 1.

Turning to FIG. 2, depicted therein is an side elevation end view of configured lower cardboard sheet 20 for lower beam member 10. In implementations lower beam member 10 includes thickness dimension DT1.

Figure 3:
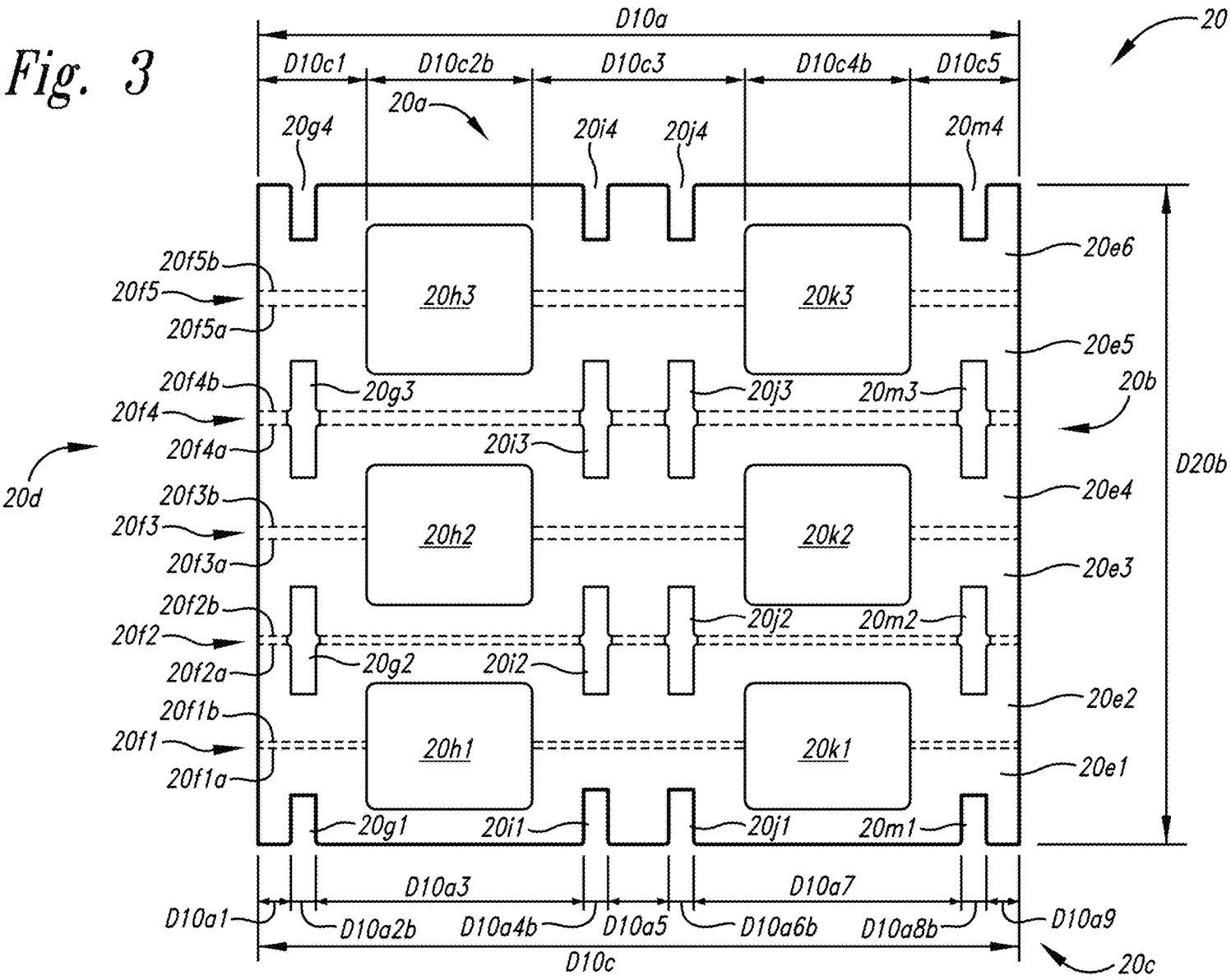
FIG. 3 is a top plan view of an unfolded configured lower sheet.

Turning to FIG. 3, depicted therein is a top plan view of configured lower cardboard sheet 20. In implementations configured lower cardboard sheet 20 includes sheet side 20*a*, sheet side 20*b* with sheet side dimension D20*b* (such as for example 1028 mm), sheet side20*c*, and sheet side 20*d*.

In implementations configured lower cardboard sheet 20 includes segment portion 20*e*1, segment portion 20*e*2, segment portion 20*e*3, segment portion 20*e*4, segment portion 20*e*5, and segment portion 20*e*6. In implementations configured lower cardboard sheet 20 includes demarcated bend line pair 20*f*1, with demarcated bend line 20*f*1*a*, and demarcated bend line 20*f*1*b*. In implementations configured lower cardboard sheet 20 includes demarcated bend line pair 20*f*2, with demarcated bend line 20*f*2*a*, and demarcated bend line 20*f*2*b*. In implementations configured lower cardboard sheet 20 includes demarcated bend line pair 20*f*3, with demarcated bend line 20*f*3*a*, and demarcated bend line 20*f*3*b*. In implementations configured lower cardboard sheet 20 includes demarcated bend line pair 20*f*4, with demarcated bend line 20*f*4*a*, and demarcated bend line 20*f*4*b*. In implementations configured lower cardboard sheet 20 includes demarcated bend line pair 20*f*5, with demarcated bend line 20*f*5*a*, and demarcated bend line 20*f*5*b*. Implementations can include bend lines that are demarcated by printing methods or means, drawing methods or means, perforating methods or means, depressive methods or means, imprinting methods or means, data storage methods or means, etc., that are known in the arts that utilize cardboard or other similar materials.

In implementations configured lower cardboard sheet 20 includes engagement notch aperture 20*g*1, engagement notch aperture 20*g*2, engagement notch aperture 20*g*3, and engagement notch aperture 20*g*4. In implementations configured lower cardboard sheet 20 includes forklift blade access cutout aperture 20*h*1, forklift blade access cutout aperture 20*h*2, and forklift blade access cutout aperture 20*h*3. In implementations configured lower cardboard sheet 20 includes engagement notch aperture 20*i*1, engagement notch aperture 2012, engagement notch aperture 2013, and engagement notch aperture 2014. In implementations configured lower cardboard sheet 20 includes engagement notch aperture 20*j*1, engagement notch aperture 20*j*2, engagement notch aperture 20*j*3, and engagement notch aperture 20*j*4. In implementations configured lower cardboard sheet 20 includes forklift blade access cutout aperture 20*k*1, forklift blade access cutout aperture 20*k*2, and forklift blade access cutout aperture 20*k*3. In implementations configured lower cardboard sheet 20 includes engagement notch aperture 20*m*1, engagement notch aperture 20*m*2, engagement notch aperture 20*m*3, and engagement notch aperture 20*m*4.

Figure 3A:
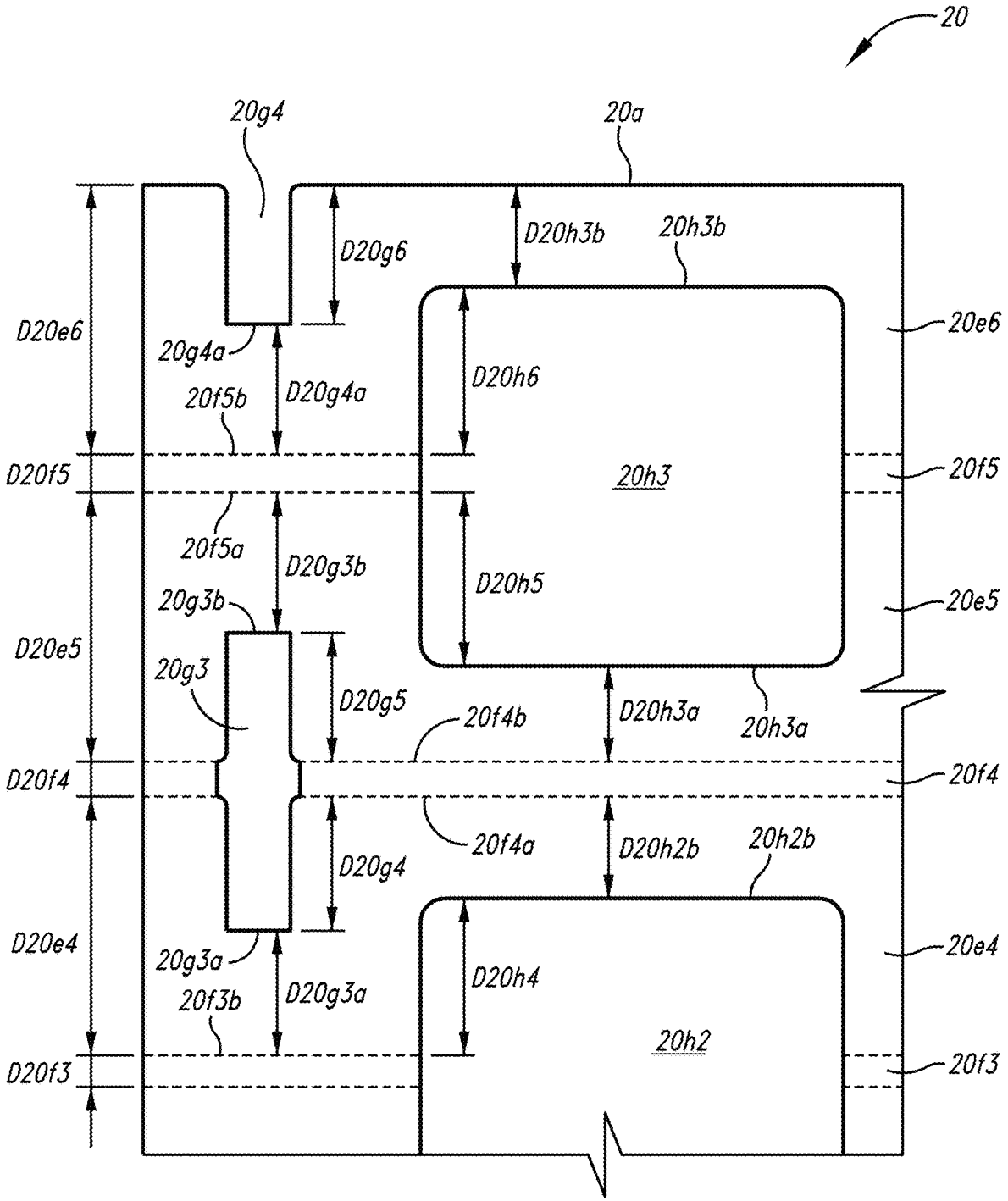
FIG. 3A is a top plan view of a portion of the unfolded configured lower sheet of FIG. 3.
Figure 3B:
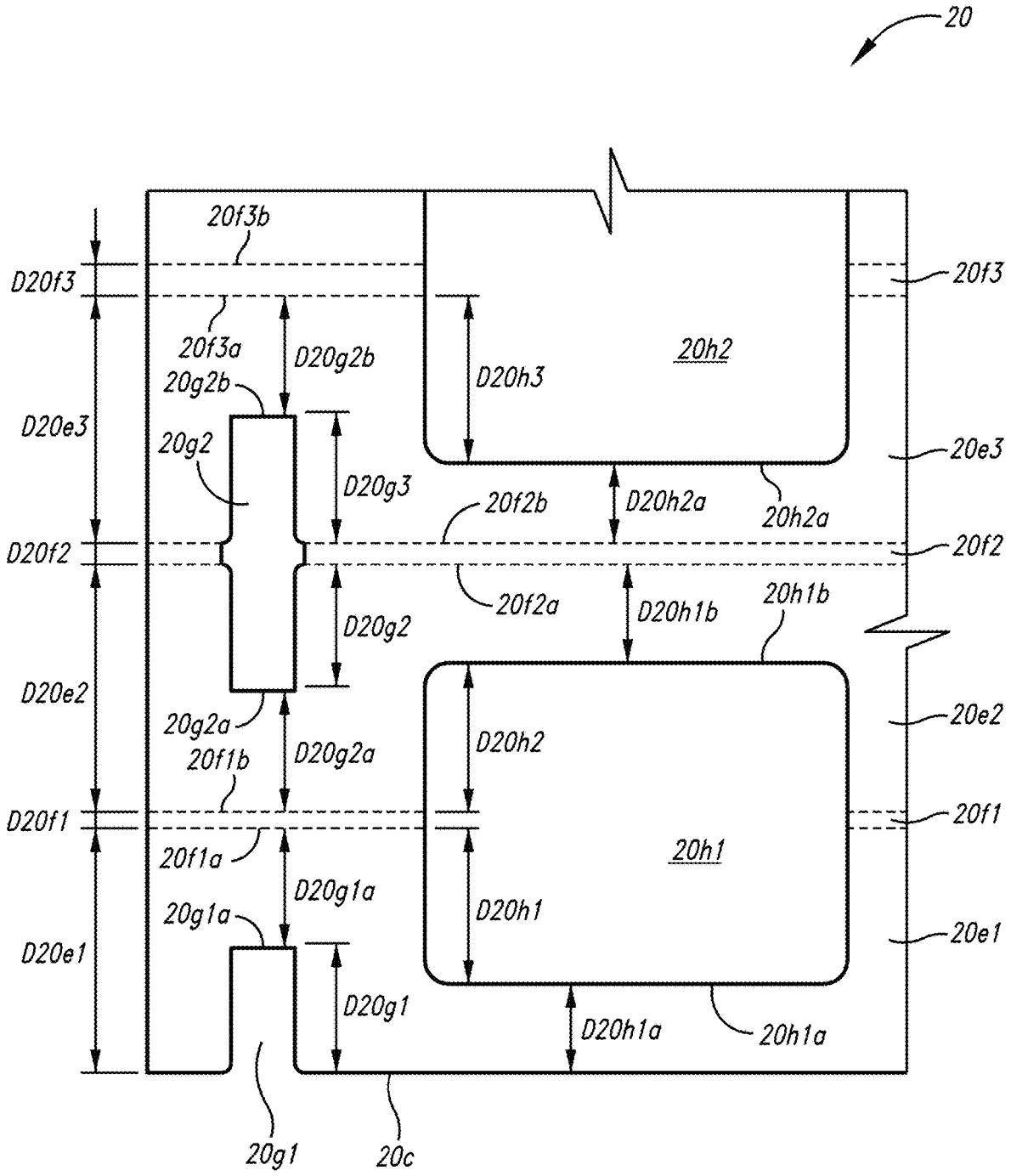
FIG. 3B is a top plan view of a portion of an abstracted version of the unfolded configured lower sheet of FIG. 3.

Turning to FIGS. 3A and 3B, depicted therein is a top plan view of a portion of configured lower cardboard sheet 20. In implementations engagement notch aperture 20*g*1 includes notch aperture side 20*g*1*a*. In implementations engagement notch aperture 20*g*2 includes notch aperture side 20*g*2*a* and notch aperture side 20*g*2*b*. In implementations engagement notch aperture 20*g*3 includes notch aperture side 20*g*3*a* and notch aperture side 20*g*3*b*. In implementations engagement notch aperture 20*g*4 includes notch aperture side 20*g*4*a*.

In implementations forklift blade access cutout aperture 20*h*1 includes access aperture side 20*h*1*a* and access aperture side 20*h*1*b*. In implementations forklift blade access cutout aperture 20*h*2 includes access aperture side 20*h*2*a* and access aperture side 20*h*2*b*. In implementations forklift blade access cutout aperture 20*h*3 includes access aperture side 20*h*3*a* and access aperture side 20*h*3*b*.

In implementations configured lower cardboard sheet 20 includes segment dimension D20*e*1 (such as for example 134 mm), segment dimension D20*e*2 (such as for example an additional factor such as whole or fractional of thickness, for instance 138 mm with a thickness of 4 mm), segment dimension D20*e*3 (such as for example an additional factor such as whole or fractional of thickness, for instance 142 mm with a thickness of 4 mm), segment dimension D20*e*4 (such as for example an additional factor such as whole or fractional of thickness, for instance 146 mm with a thickness of 4 mm), segment dimension D20*e*5 (such as for example an additional factor such as whole or fractional of thickness, for instance 150 mm with a thickness of 4 mm), and segment dimension D20*e*6 (such as for example an additional factor such as whole or fractional of thickness, but a bit less than previous, for instance 147 mm with a thickness of 4 mm).

In implementations configured lower cardboard sheet 20 includes bend line pair dimension D20*f*1 (such as for example a factor such as whole or fractional of thickness, for instance 7 mm with a thickness of 4 mm or 1.5× thickness), bend line pair dimension D20*f*2 (such as for example a factor such as whole or fractional of thickness, for instance 10 mm with a thickness of 4 mm or 2.5× thickness), bend line pair dimension D20*f*3 (such as for example a factor such as whole or fractional of thickness, for instance 17 mm with a thickness of 4 mm or 4× thickness), bend line pair dimension D20*f*4 (such as for example a factor such as whole or fractional of thickness, for instance 20 mm with a thickness of 4 mm or 5× thickness), and bend line pair dimension D20*f*5 (such as for example a factor such as whole or fractional of thickness, for instance 27 mm with a thickness of 4 mm or 6.5×thickness).

In implementations engagement notch aperture 20*g*1 includes notch aperture dimension D20*g*1 (such as for example 69 mm) and spacing dimension D20*g*1*a*. In implementations engagement notch aperture 20*g*2 includes notch aperture dimension dD20*g*2 (such as for example 73 mm), notch aperture dimension D20*g*3 (such as for example 73 mm), spacing dimension D20*g*2*a*, and spacing dimension D20*g*2*b*. In implementations engagement notch aperture 20*g*3 includes notch aperture dimension D20*g*4 (such as for example 77 mm), notch aperture dimension D20*g*5, spacing dimension D20*g*3*a* (such as for example 77 mm), and spacing dimension D20*g*3*b*. In implementations engagement notch aperture 20*g*4 includes notch aperture dimension D20*g*6 (such as for example 74 mm) and spacing dimension D20*g*4*a*.

In implementations forklift blade access cutout aperture 20*h*1 includes access aperture dimension D20*h*1, (such as for example 82 mm), access aperture dimension D20*h*2 (such as for example 82 mm), spacing dimension D20*h*1*a*, and spacing dimension D20*h*1*b*. In implementations forklift blade access cutout aperture 20*h*2 includes access aperture dimension D20*h*3 (such as for example 86 mm), access aperture dimension D20*h*4 (such as for example 86 mm), spacing dimension D20*h*2*a*, and spacing dimension D20*h*2*b*. In implementations forklift blade access cutout aperture 20*h*3 includes access aperture dimension D20*h*5 (such as for example 90 mm), and access aperture dimension D20*h*6 (such as for example 90 mm), spacing dimension D20*h*3*a*, and spacing dimension D20*h*2*b*.

Figure 3C:
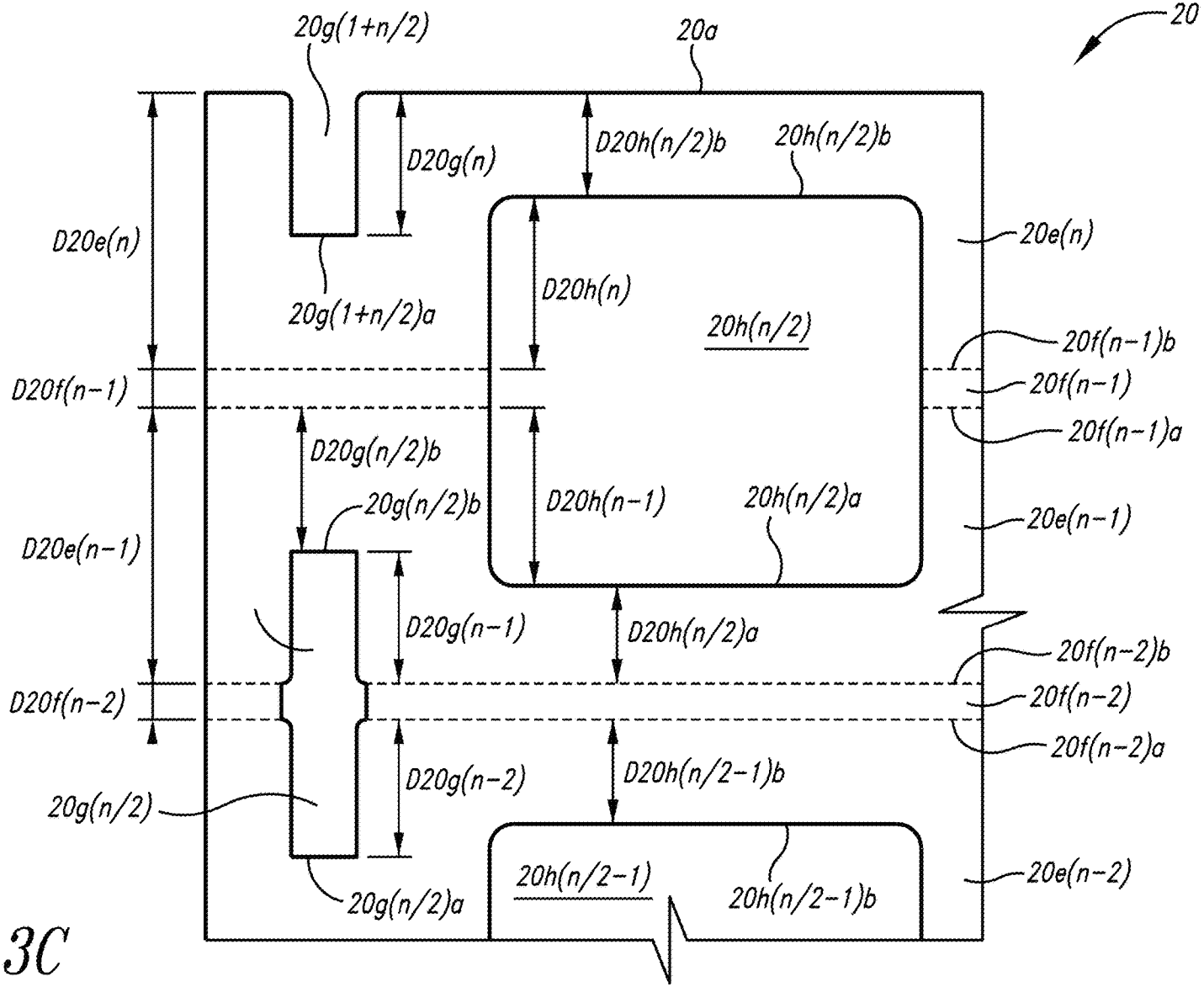
FIG. 3C is a top plan view of a portion of an abstracted version of the unfolded configured lower sheet of FIG. 3.

Turning to FIG. 3C, depicted therein is a top plan view of a portion of an abstracted version of configured lower cardboard sheet 20. In implementations configured lower cardboard sheet 20 includes segment portion 20*e*(n−2), segment portion 20*e*(n−1), and segment portion 20*e*(n). In implementations configured lower cardboard sheet 20 includes demarcated bend line pair 20*f*(n−2) with demarcated bend line 20*f*(n−2)a, demarcated bend line 20*f*(n−2)b. In implementations configured lower cardboard sheet 20 includes demarcated bend line pair 20*f*(n−1) with demarcated bend line 20*f*(n−1)a, and demarcated bend line 20*f*(n−1)b.

In implementations configured lower cardboard sheet 20 includes engagement notch aperture 20*g*(n/2) with notch aperture side 20*g*(n/2)a, and notch aperture side 20*g*(n/2)b. In implementations configured lower cardboard sheet 20 includes engagement notch aperture 20*g*(1+n/2) with notch aperture side 20*g*(1+n/2)a. In implementations configured lower cardboard sheet 20 includes forklift blade access cutout aperture 20*h*(n/2−1) with access aperture side 20*h*(n/2−1)b. In implementations configured lower cardboard sheet 20 includes forklift blade access cutout aperture 20*h*(n/2) with access aperture side 20*h*(n/2)a, and forklift blade access cutout aperture 20*h*(n/2)b.

In implementations configured lower cardboard sheet 20 includes segment dimension D20*e*(n−1), and segment dimension D20*e*(n). In implementations configured lower cardboard sheet 20 includes bend line pair dimension D20*f*(n−2), and bend line pair dimension D20*f*(n−1). In implementations 20*g*(n/2)−D20*g*(n/2) includes notch aperture dimension D20*g*(n−2), notch aperture dimension D20*g*(n−1), and spacing dimension D20*g*(n/2)b. In implementations engagement notch aperture 20*g*(1+n/2) includes notch aperture dimension D20*g*(n) and spacing dimension D20*g*(1+n/2). In implementations configured lower cardboard sheet 20 includes spacing dimension D20*h*(n/2−1)b, spacing dimension D20*h*(n/2)a, and spacing dimension D20*h*(n/2)b. In implementations configured lower cardboard sheet 20 includes access aperture dimension D20*h*(n−1), and access aperture dimension D20*h*(n).

Figure 3D:
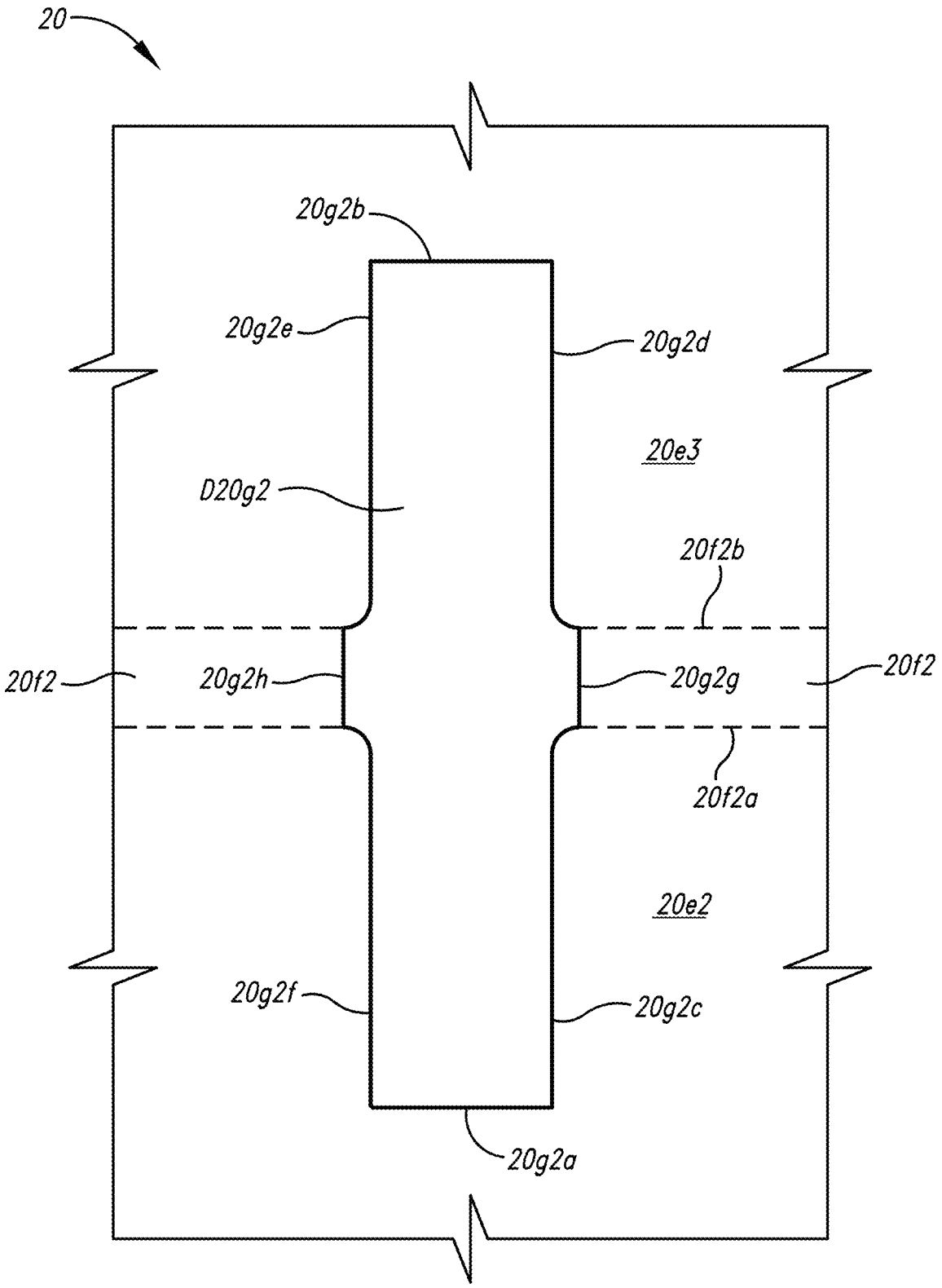
FIG. 3D is a top plan view of an enlarged portion of the unfolded configured lower sheet of FIG. 3.

Turning to FIG. 3D, depicted therein is a top plan view of an enlarged portion of configured lower cardboard sheet 20. In implementations configured lower cardboard sheet 20 includes notch aperture side portion 20*g*2*c*, notch aperture side portion 20*g*2*d*, notch aperture side portion 20*g*2*e*, notch aperture side portion 20*g*2*f*, engagement notch aperture radius portion 20*g*2*g*, and engagement notch aperture radius portion 20*g*2*h*.

Figure 4:
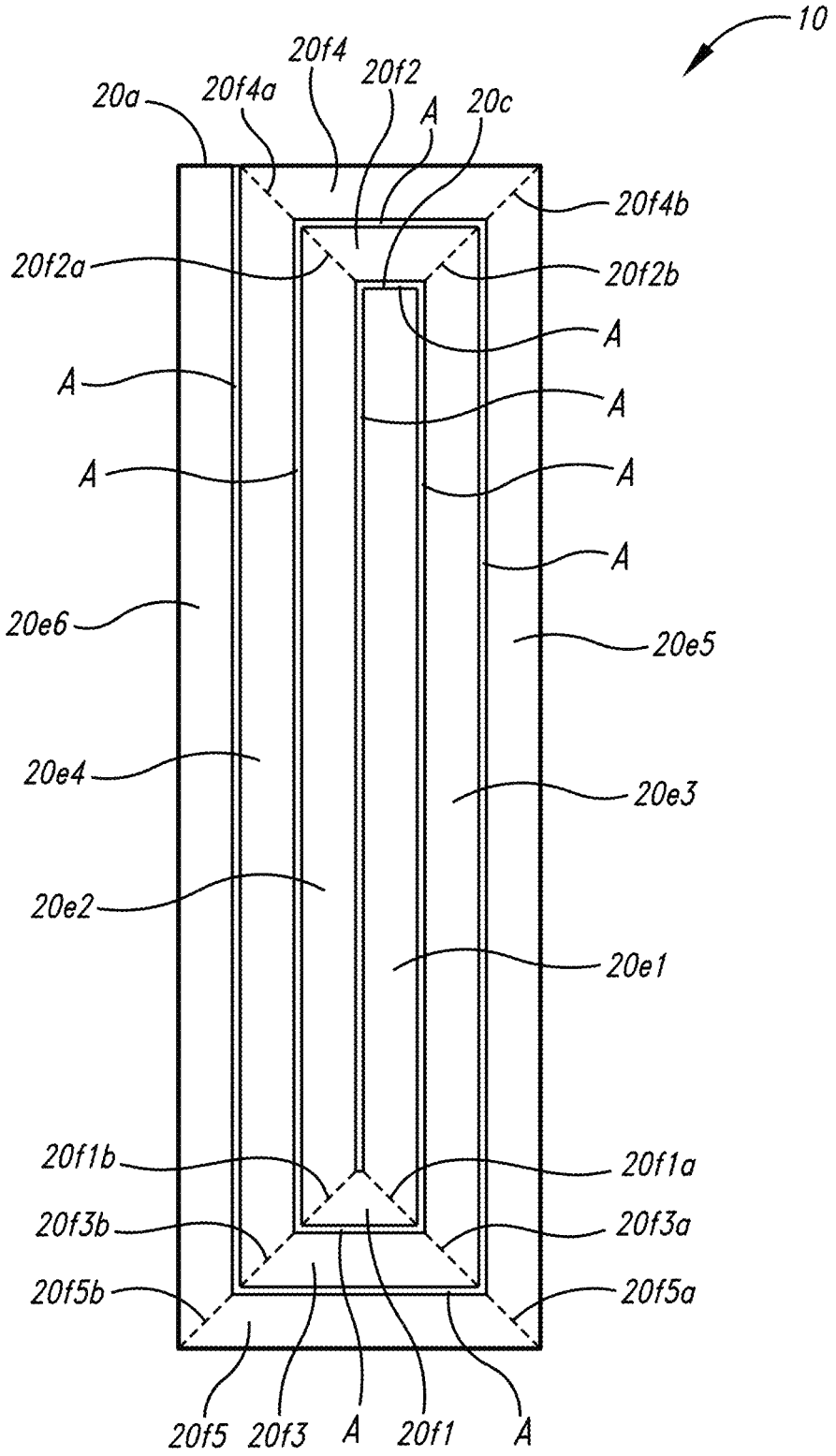
FIG. 4 is an side elevation end view of an folded configured lower sheet.

Turning to FIG. 4, depicted therein is a side elevation end view of lower beam member 10 further including adhesive A. As depicted, configured lower cardboard sheet 20 is bent at demarcated bend line 20*f*1*a*, demarcated bend line 20*f*1*b*, demarcated bend line 20*f*2*a*, demarcated bend line 20*f*2*b*, demarcated bend line 20*f*3*a*, demarcated bend line 20*f*3*b*, demarcated bend line 20*f*4*a*, demarcated bend line 20*f*4*b*, demarcated bend line 20*f*5*a*, and demarcated bend line 20*f*5*b* to thereby form lower beam member 10. As depicted, consequently segment portion 20*e*1, segment portion 20*e*2, segment portion 20*e*3, segment portion 20*e*4, segment portion 20*e*5, and segment portion 20*e*6 are oriented parallel with one another in alternating juxtaposition with adhesive A therebetween.

Figure 5:
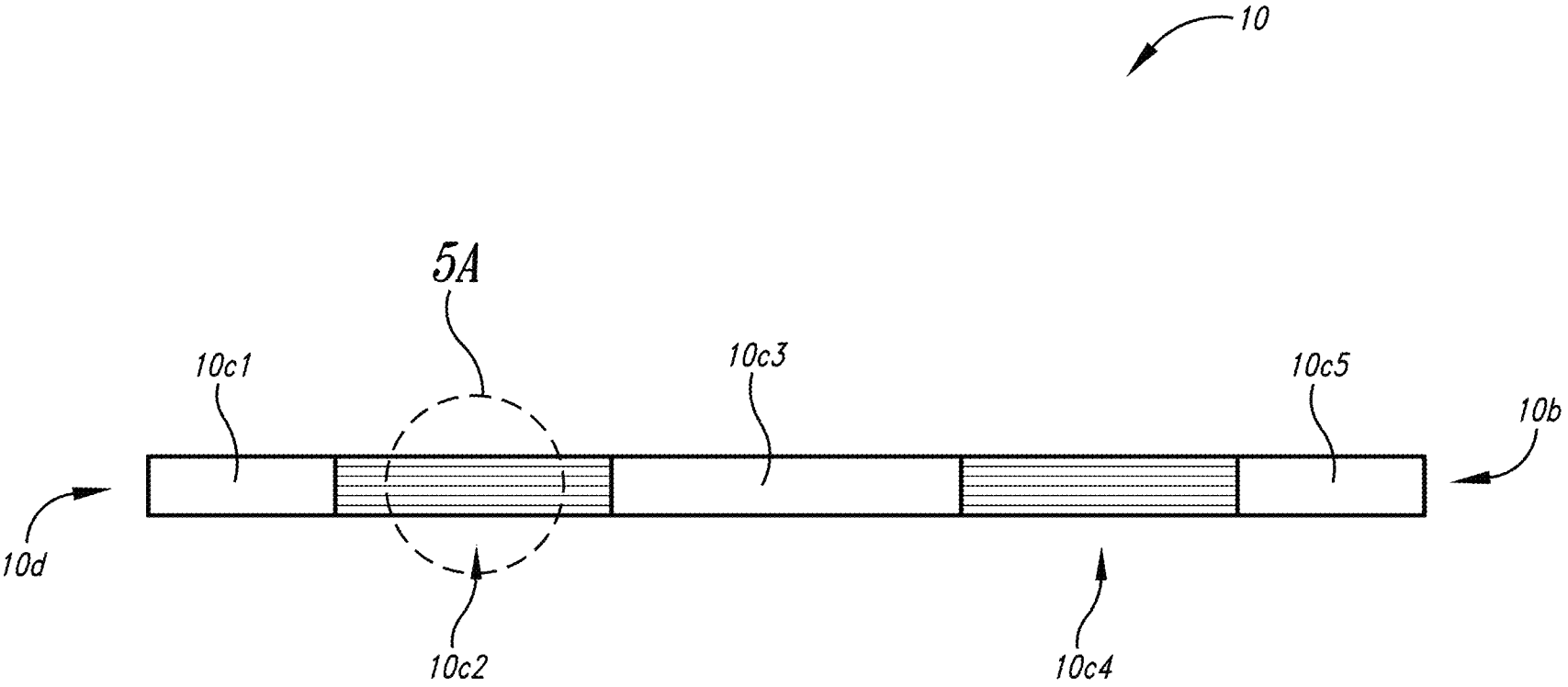
FIG. 5 is a bottom plan view of the lower beam member of FIG. 1.

Turning to FIG. 5, depicted therein is a bottom plan view of lower beam member 10.

Figure 5A:
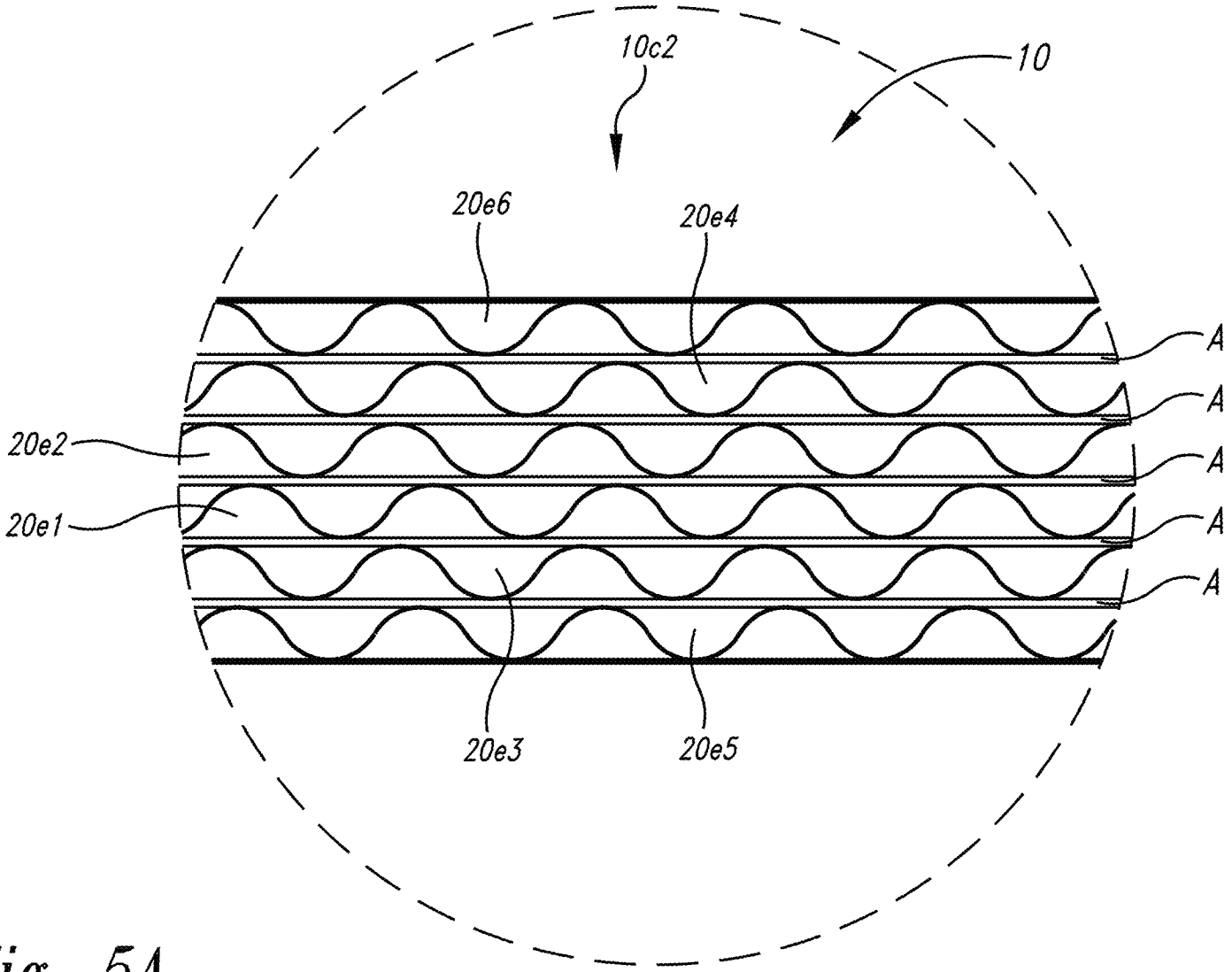
FIG. 5A is an enlarged bottom plan view of a portion of the lower beam member of FIG. 1.

Turning to FIG. 5A, depicted therein is an enlarged bottom plan view of a portion of lower beam member 10 showing corrugated cardboard portions thereof in which corrugated cardboard ribs are arranged transverse to demarcated bend line 20*f*1*a*, demarcated bend line 20*f*1*b*, demarcated bend line 20*f*2*a*, demarcated bend line 20*f*2*b*, demarcated bend line 20*f*3*a*, demarcated bend line 20*f*3*b*, demarcated bend line 20*f*4*a*, demarcated bend line 20*f*4*b*, demarcated bend line 20*f*5*a*, and demarcated bend line 20*f*5*b*.

Figure 6:
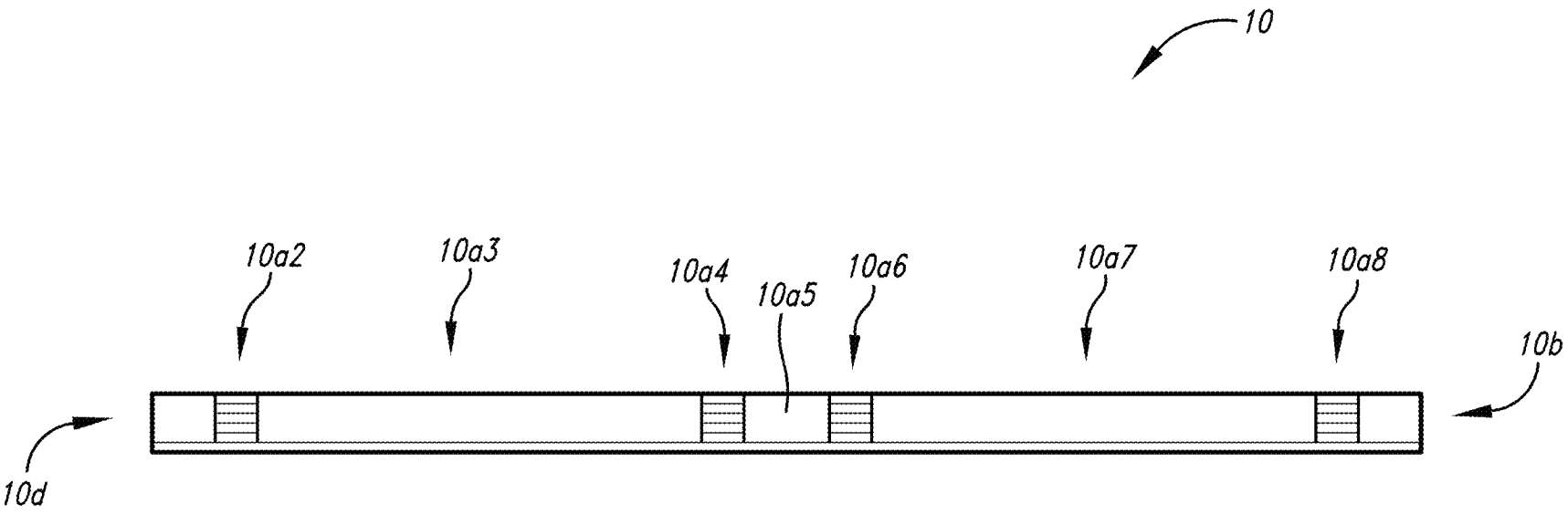
FIG. 6 is a top plan view of the lower beam member of FIG. 1.

Turning to FIG. 6, depicted therein is a top plan view of lower beam member 10.

Figure 7:
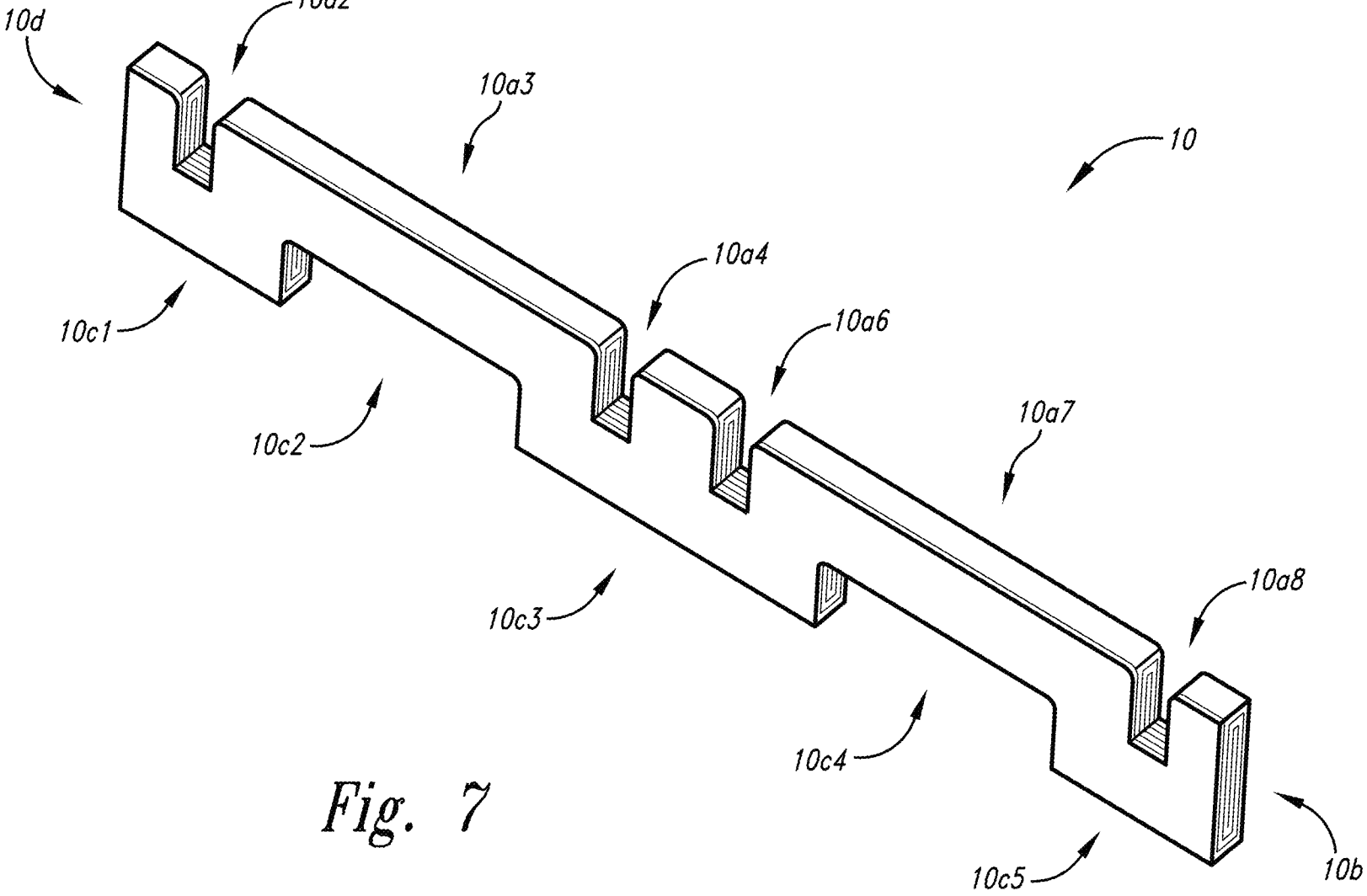
FIG. 7 is a perspective view of the lower beam member of FIG. 1.

Turning to FIG. 7, depicted therein is a perspective view of lower beam member 10.

Figure 8:
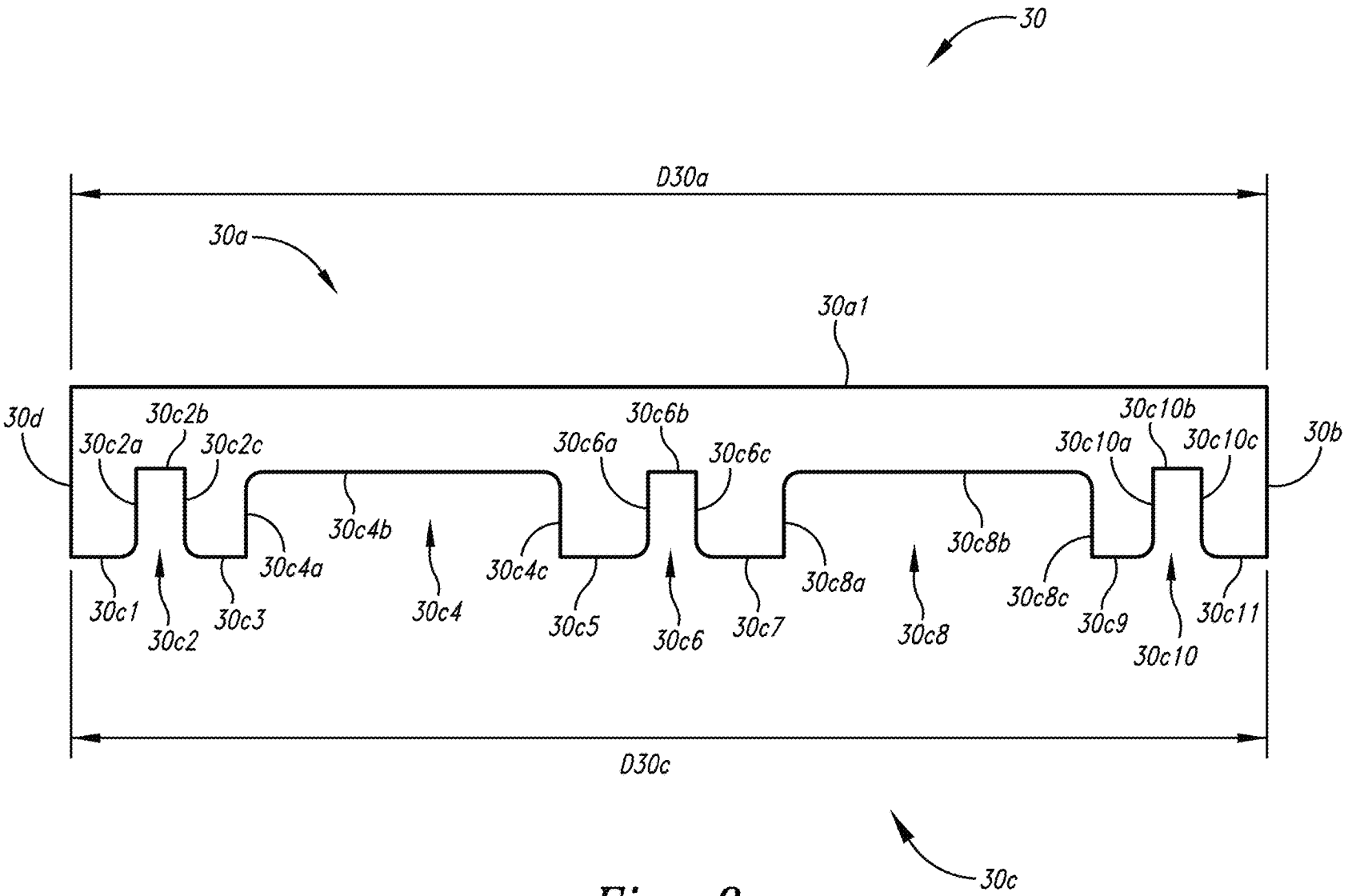
FIG. 8 is a side elevation view of an upper beam member.

Turning to FIG. 8, depicted therein is a side elevation view of upper beam member 30, which is the bent configuration of configured upper cardboard sheet 40 discussed below. In implementations upper beam member 30 includes beam side 30*a*, beam side 30*b*, and beam side 30*c*, and beam side 30*d*. In implementations beam side 30*a* includes side portion 30*a*1.

In implementations beam side 30*c* includes side portion 30*c*1, engagement notch 30*c*2, side portion 30*c*3, and forklift blade access cutout 30*c*4. In implementations engagement notch 30*c*2 includes notch side 30*c*2*a*, notch side 30*c*2*b*, and notch side 30*c*2*c*. In implementations forklift blade access cutout 30*c*4 includes access side 30*c*4*a*, access side 30*c*4*b*, and access side 30*c*4*c*. In implementations beam side 30*c* includes side portion 30*c*5, engagement notch 30*c*6, side portion 30*c*7, forklift blade access cutout 30*c*8, side portion 30*c*9, engagement notch 30*c*10, and side portion 30*c*11. In implementations engagement notch 30*c*6 includes notch side 30*c*6*a*, notch side 30*c*6*b*, and notch side 30*c*6*c*. In implementations forklift blade access cutout 30*c*8 includes access side 30*c*8*a*, access side 30*c*8*b*, and access side 30*c*8*c*. In implementations engagement notch 30*c*10 includes notch side 30*c*10*a*, notch side 30*c*10*b*, and notch side 30*c*10*c*.

Figure 8A:
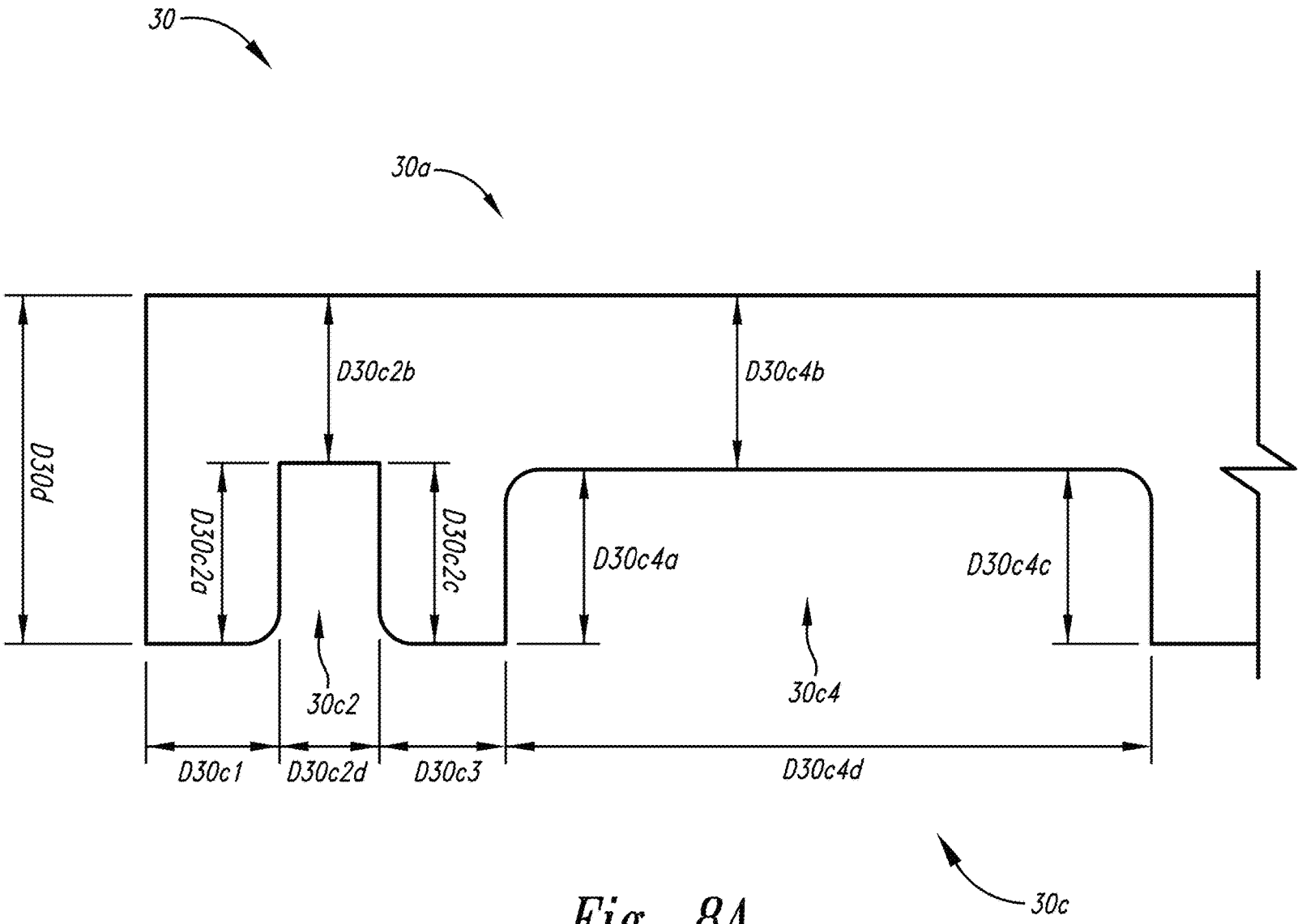
FIG. 8A is a side elevation view of a portion of the upper beam member of FIG. 8.

In implementations upper beam member 30 includes side dimension D30*a* (such as for example 1200 mm), and side dimension D30*c* (such as for example 1200 mm). Turning to FIG. 8A, depicted therein is a side elevation view of a portion of upper beam member 30. In implementations side portion 30*cl* includes side portion dimension D30*c*1. In implementations engagement notch 30*c*2 includes notch side dimension D30*c*2*a*, spacing dimension D30*c*2*b*, notch side dimension D30*c*2*c*, and notch side dimension D30*c*2*d* (such as for example 37 mm). In implementations side portion 30*c*3 includes side portion dimension D30*c*3. In implementations forklift blade access cutout 30*c*4 includes access side dimension D30*c*4*a*, spacing dimension D30*c*4*b*, access side dimension D30*c*4*c*, and access side dimension D30*c*4*d* (such as for example 210 or 255 mm).

Figure 8B:
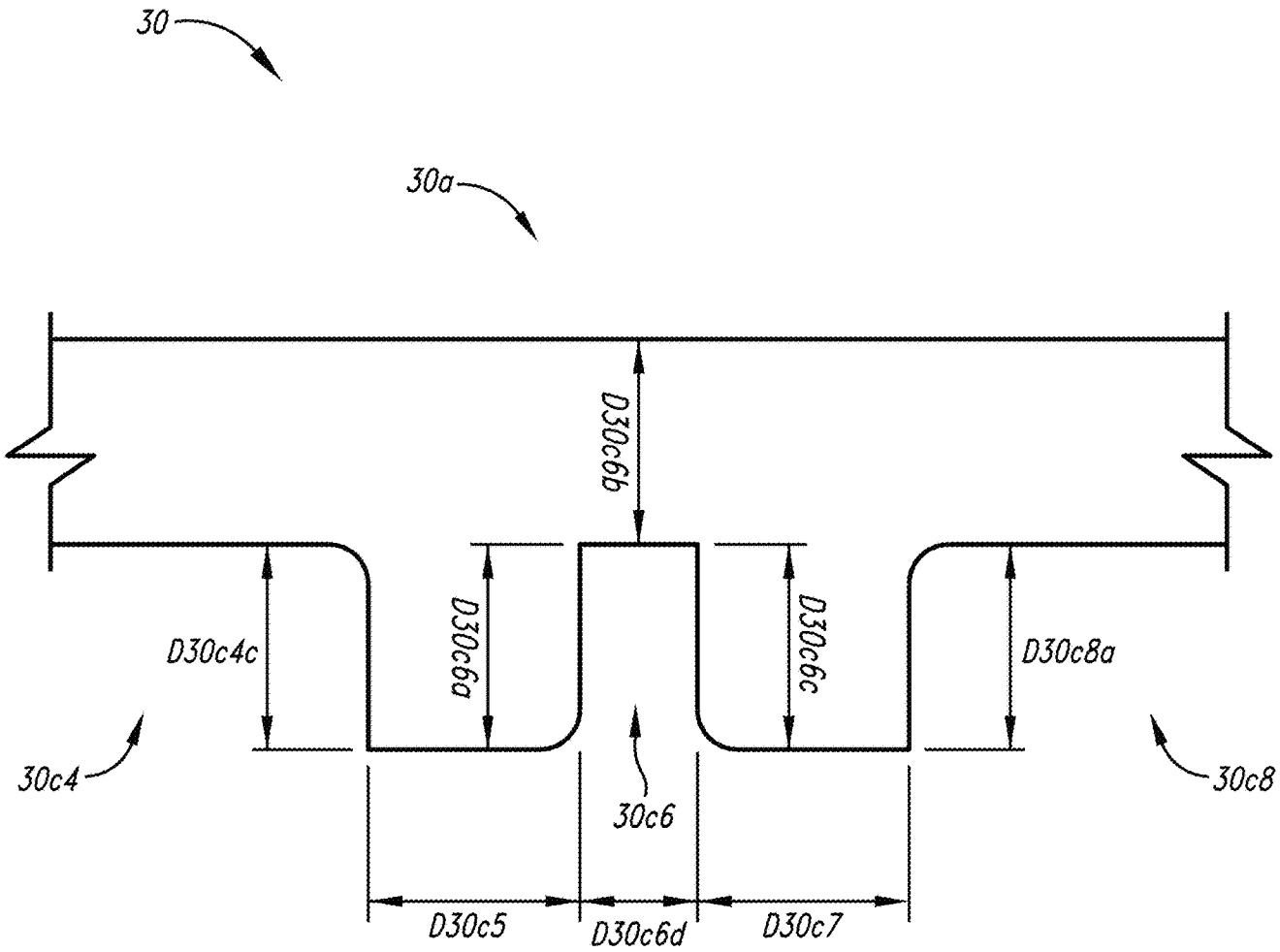
FIG. 8B is a side elevation view of a portion of the upper beam member of FIG. 8.

Turning to FIG. 8B, depicted therein is a side elevation view of a portion of upper beam member 30. In implementations side portion 30*c*5 includes side portion dimension D30*c*5. In implementations engagement notch 30*c*6 includes notch side dimension D30*c*6*a*, spacing dimension D30*c*6*b*, notch side dimension D30*c*6*c*, and notch side dimension D30*c*6*d*. In implementations side portion 30*c*7 includes side portion dimension D30*c*7. In implementations forklift blade access cutout 30*c*8 includes access side dimension D30*c*8*a*.

Figure 8C:
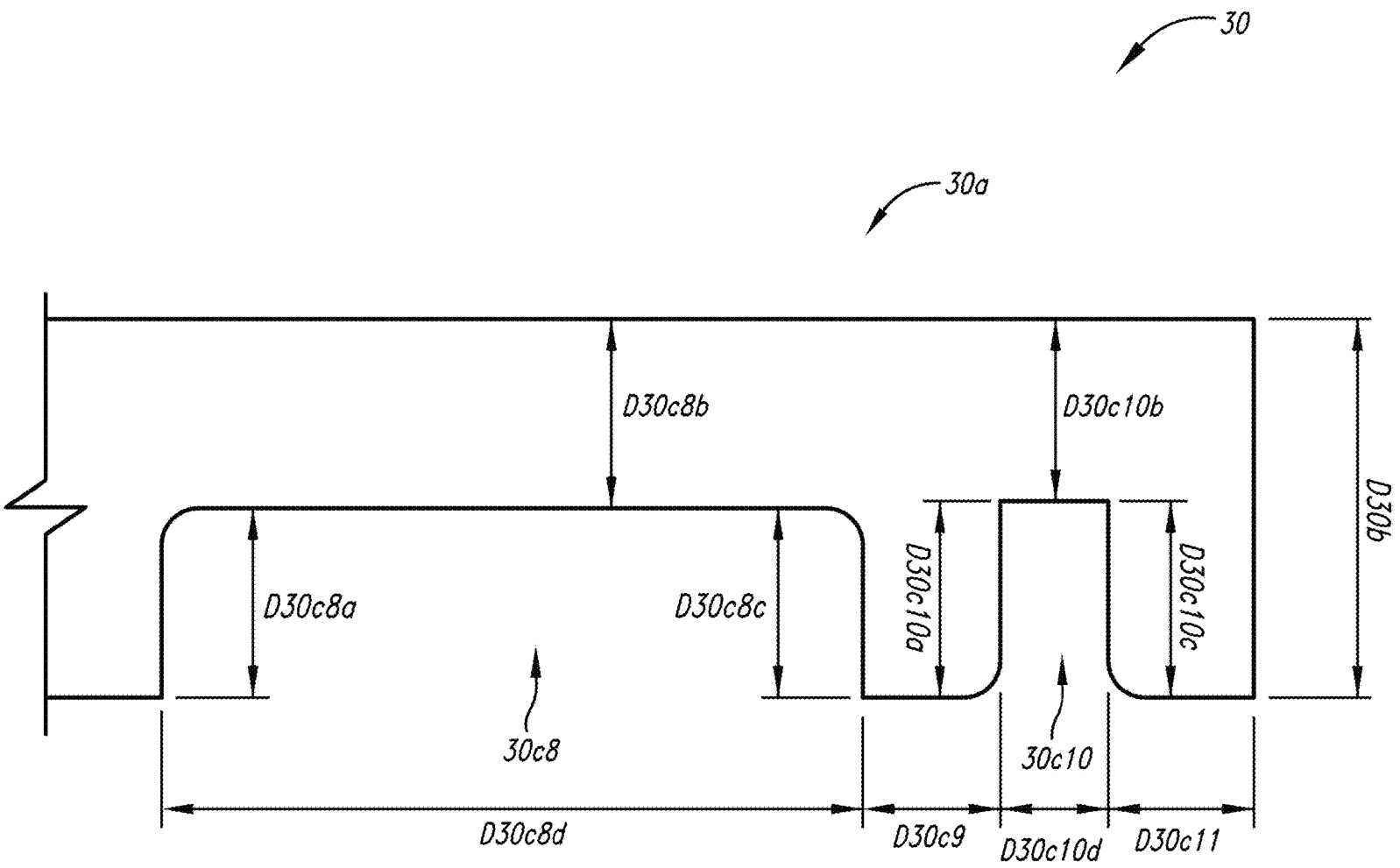
FIG. 8C is a side elevation view of a portion of the upper beam member of FIG. 8.

Turning to FIG. 8C, depicted therein is a side elevation view of a portion of upper beam member 30. In implementations forklift blade access cutout 30*c*8 includes spacing dimension D30*c*8*b*, access side dimension D30*c*8*c*, and access side dimension D30*c*8*d*. In implementations side portion 30*c*9 includes side portion dimension D30*c*9. In implementations engagement notch 30*c*10 includes notch side dimension D30*c*10*a*, spacing dimension D30*c*10*b*, notch side dimension D30*c*10*c*, and notch side dimension D30*c*10*d*. In implementations side portion 30*c*11 includes side portion dimension D30*c*11.

Figure 9:
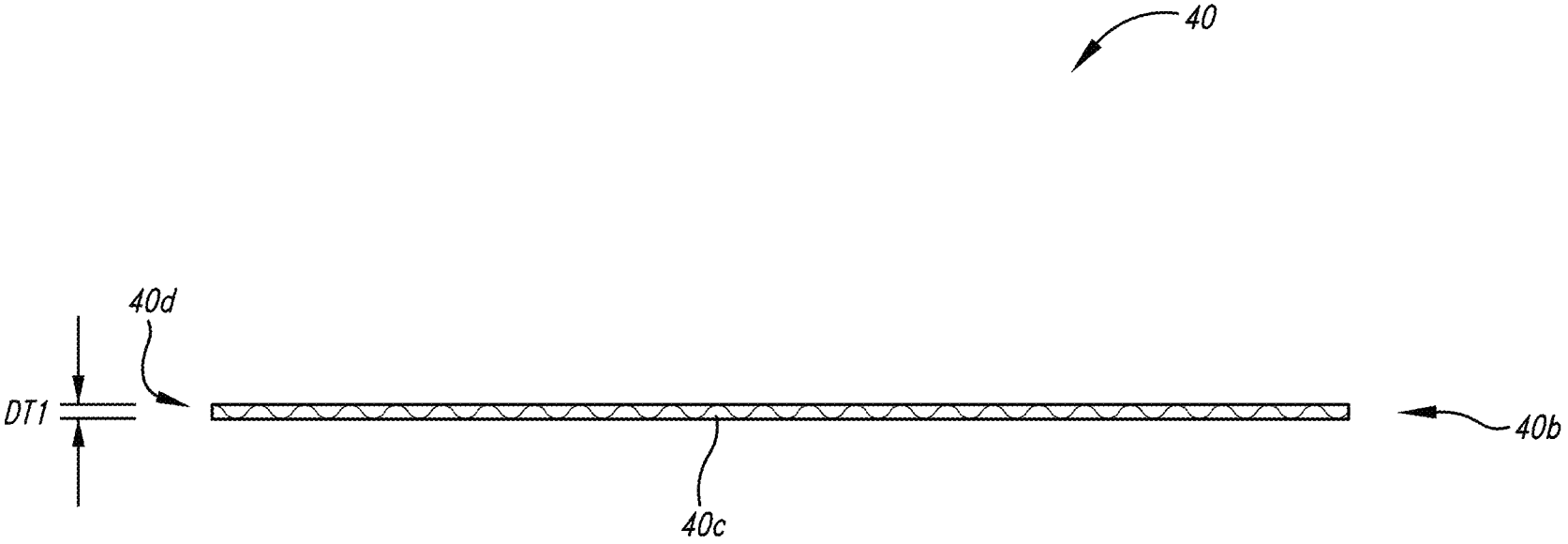
FIG. 9 is an side elevation end view of an unfolded configured upper sheet for the upper beam member of FIG. 8.

Turning to FIG. 9, depicted therein is a side elevation end view of configured upper cardboard sheet 40 for upper beam member 30. In implementations upper beam member 30 includes thickness dimension DT2 (such as for example 4 mm or 6 mm).

Figure 10:
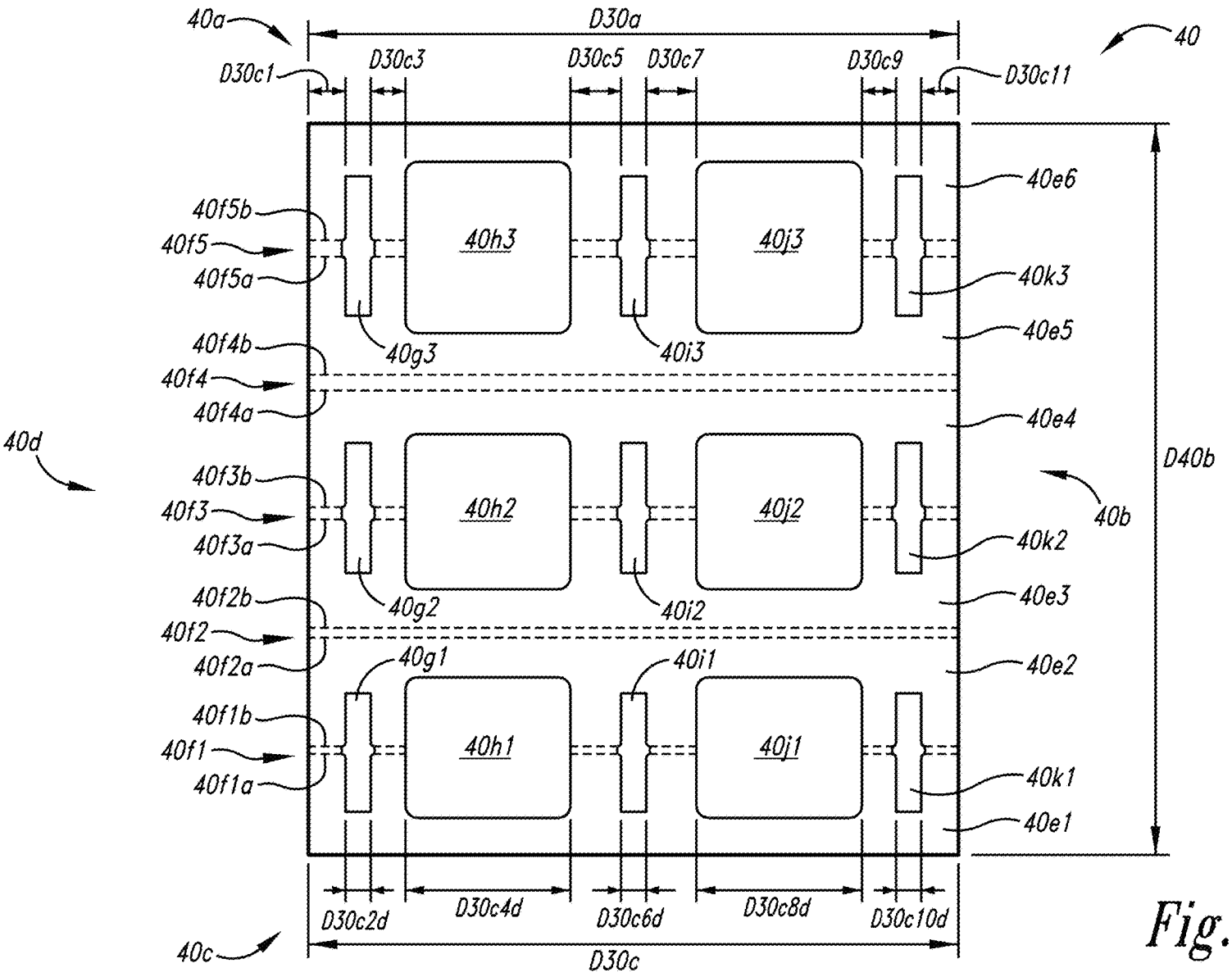
FIG. 10 is a top plan view of the unfolded configured upper sheet of FIG. 9.

Turning to FIG. 10, depicted therein is a top plan view of configured upper cardboard sheet 40. In implementations configured upper cardboard sheet 40 includes sheet side 40*a*, sheet side 40*b* with sheet side dimension D40*b* (such as for example 1028 mm), sheet side 40*c*, and sheet side 40*d*. In implementations configured upper cardboard sheet 40 includes segment portion 40*e*1, segment portion 40*e*2, segment portion 40*e*3, segment portion 40*e*4, segment portion 40*e*5, and segment portion 40*e*6.

In implementations configured upper cardboard sheet 40 includes demarcated bend line pair 40*f*1 with demarcated bend line 40*f*1*a*, and demarcated bend line 40*f*1*b*. In implementations configured upper cardboard sheet 40 includes demarcated bend line pair 40*f*2 with demarcated bend line 40*f*2*a*, and demarcated bend line 40*f*2*b*. In implementations configured upper cardboard sheet 40 includes demarcated bend line pair 40*f*3 with demarcated bend line 40*f*3*a*, and demarcated bend line 40*f*3*b*. In implementations configured upper cardboard sheet 40 includes demarcated bend line pair 40*f*4 with demarcated bend line 40*f*4*a*, and demarcated bend line 40*f*4*b*. In implementations configured upper cardboard sheet 40 includes demarcated bend line pair 40*f*5 with demarcated bend line 40*f*5*a*, and demarcated bend line 40*f*5*b*.

In implementations configured upper cardboard sheet 40 includes engagement notch aperture 40*g*1, engagement notch aperture 40*g*2, and engagement notch aperture 40*g*3. In implementations configured upper cardboard sheet 40 includes forklift blade access cutout aperture 40*h*1, forklift blade access cutout aperture 40*h*2, and forklift blade access cutout aperture 40*h*3. In implementations configured upper cardboard sheet 40 includes engagement notch aperture 40*i*1, engagement notch aperture 4012, and engagement notch aperture 40*i*3. In implementations configured upper cardboard sheet 40 includes forklift blade access cutout aperture 40*j*1, forklift blade access cutout aperture 40*j*2, and forklift blade access cutout aperture 40*j*3. In implementations configured upper cardboard sheet 40 includes engagement notch aperture 40*k*1, engagement notch aperture 40*k*2, and engagement notch aperture 40*k*3.

Figure 10A:
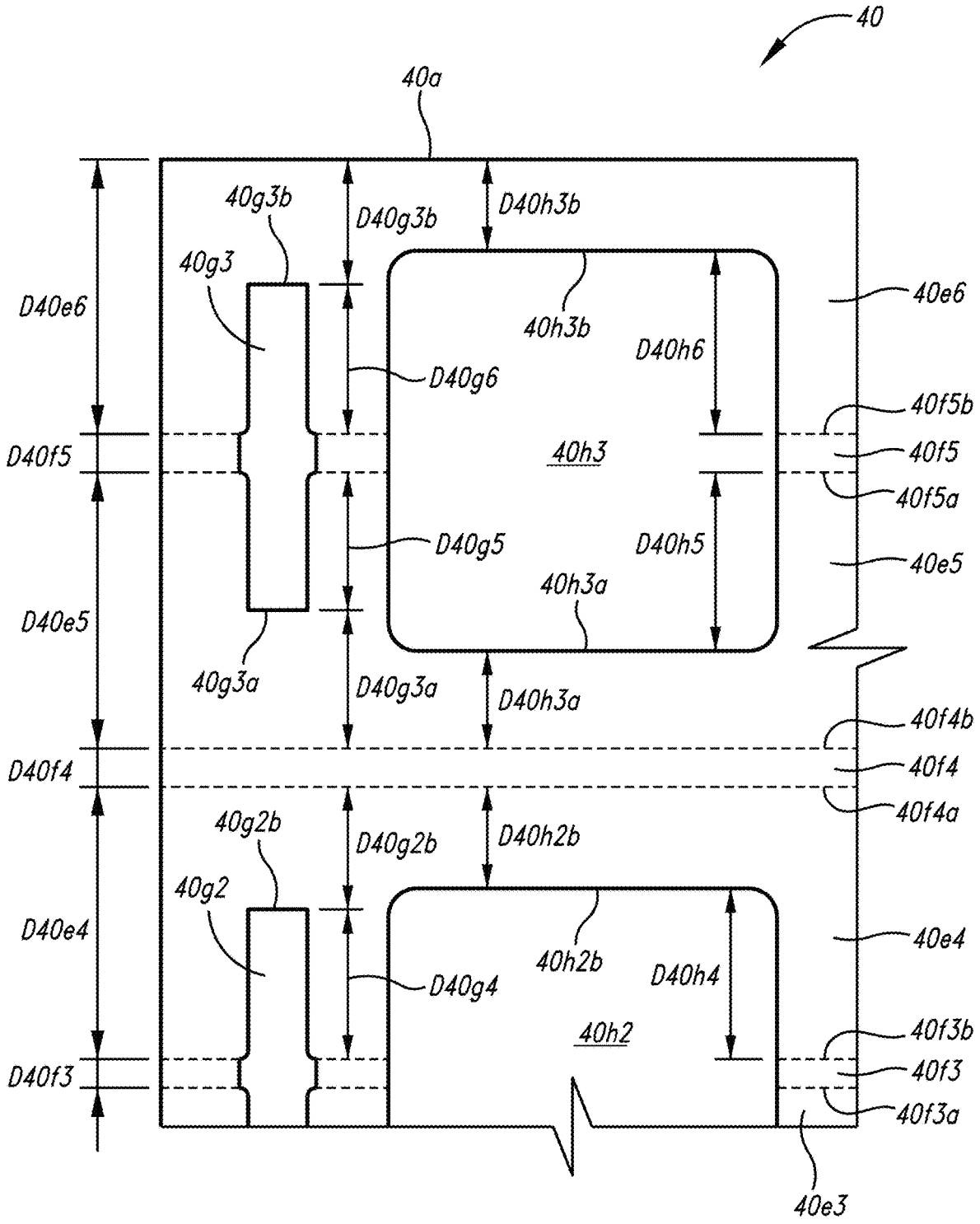
FIG. 10A is a top plan view of a portion of the unfolded configured upper sheet of FIG. 9.
Figure 10B:
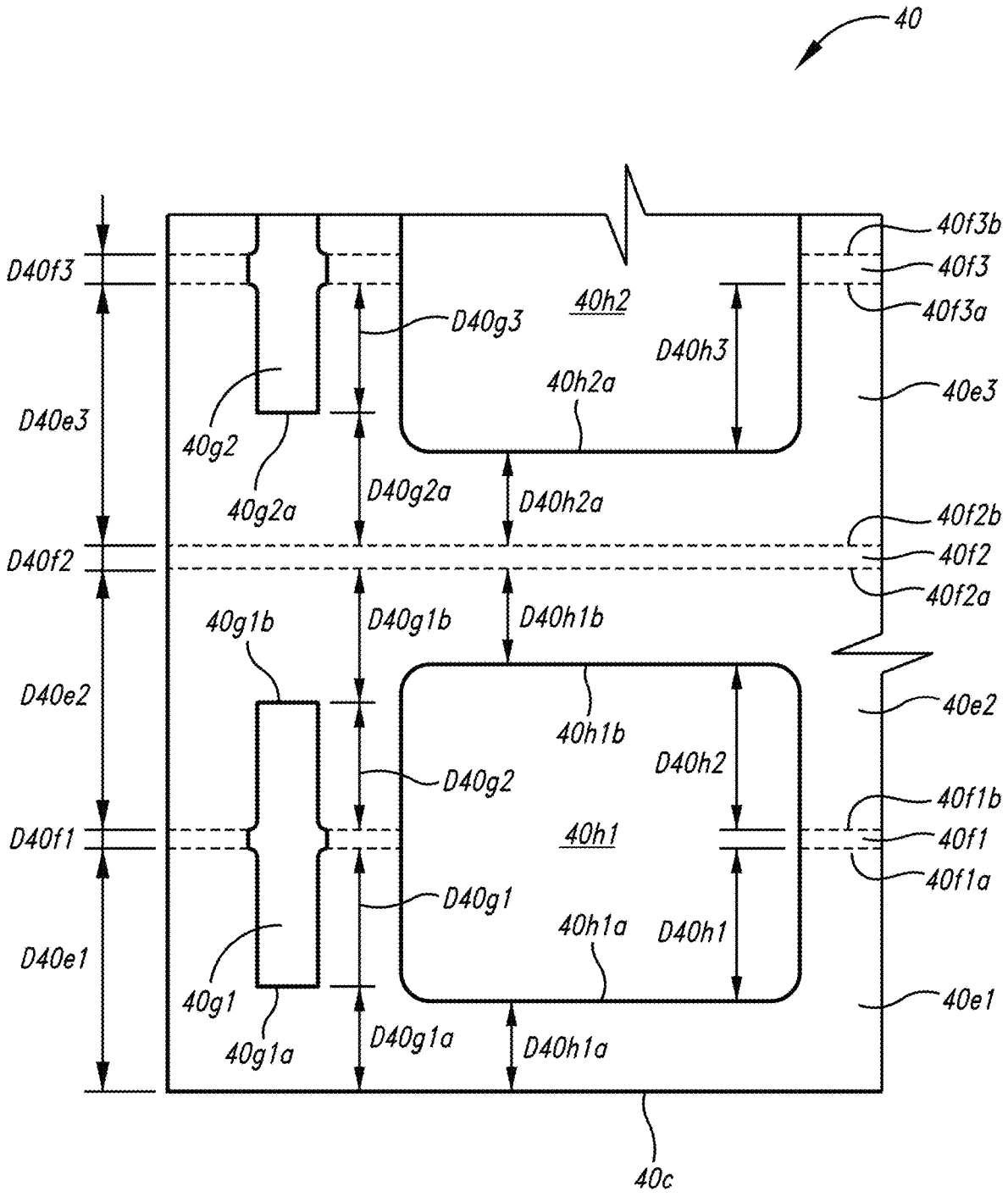
FIG. 10B is a top plan view of a portion of the unfolded configured upper sheet of FIG. 9.

Turning to FIGS. 10A and 10B, depicted therein is a top plan view of a portion of configured upper cardboard sheet 40. In implementations engagement notch aperture 40*g*1 includes notch aperture side 40*g*1*a*, and notch aperture side 40*g*1*b*. In implementations engagement notch aperture 40*g*2 includes notch aperture side 40*g*2*a*, and notch aperture side 40*g*2*b*. In implementations engagement notch aperture 40*g*3 includes notch aperture side 40*g*3*a*, and notch aperture side 40*g*3*b*.

In implementations forklift blade access cutout aperture 40*h*1 includes access aperture side 40*h*1*a*, and access aperture side 40*h*1*b*. In implementations forklift blade access cutout aperture 40*h*2 includes access aperture side 40*h*2*a*, and access aperture side 40*h*2*b*. In implementations forklift blade access cutout aperture 40*h*3 includes access aperture side 40*h*3*a*, and access aperture side 40*h*3*b*.

In implementations configured upper cardboard sheet 40 includes segment dimension D40*e*1 (such as for example 134 mm), segment dimension D40*e*2 (such as for example an additional factor such as whole or fractional of thickness, for instance 138 mm with a thickness of 4 mm), segment dimension D40*e*3 (such as for example an additional factor such as whole or fractional of thickness, for instance 142 mm with a thickness of 4 mm), segment dimension D40*e*4 (such as for example an additional factor such as whole or fractional of thickness, for instance 146 mm with a thickness of 4 mm), segment dimension D40*e*5 (such as for example an additional factor such as whole or fractional of thickness, for instance 150 mm with a thickness of 4 mm), and segment dimension D40*e*6 (such as for example an additional factor such as whole or fractional of thickness, but a bit less than previous, for instance 147 mm with a thickness of 4 mm).

In implementations configured upper cardboard sheet 40 includes bend line pair dimension D40*f*1, bend line pair dimension D40*f*2, bend line pair dimension D40*f*3, bend line pair dimension D40*f*4, and bend line pair dimension D40*f*5. In implementations configured upper cardboard sheet 40 includes bend line pair dimension D40*f*1 (such as for example a factor such as whole or fractional of thickness, for instance 7 mm with a thickness of 4 mm or 1.5×thickness), bend line pair dimension D40*f*2 (such as for example a factor such as whole or fractional of thickness, for instance 10 mm with a thickness of 4 mm or 2.5× thickness), bend line pair dimension D40*f*3 (such as for example a factor such as whole or fractional of thickness, for instance 17 mm with a thickness of 4 mm or 4× thickness), bend line pair dimension D40*f*4 (such as for example a factor such as whole or fractional of thickness, for instance 20 mm with a thickness of 4 mm or 5× thickness), and bend line pair dimension D40*f*5 (such as for example a factor such as whole or fractional of thickness, for instance 27 mm with a thickness of 4 mm or 6.5× thickness).

In implementations engagement notch aperture 40*g*1 includes notch aperture dimension D40*g*1 (such as for example 69 mm), notch aperture dimension D40*g*2 (such as for example 69 mm), spacing dimension D40*g*1*a*, and spacing dimension D40*g*1*b*. In implementations engagement notch aperture 40*g*2 includes notch aperture dimension D40*g*3 (such as for example 73 mm), notch aperture dimension D40*g*4 (such as for example 73 mm), spacing dimension D40*g*2*a*, and spacing dimension D40*g*2*b*. In implementations engagement notch aperture 40*g*3 includes notch aperture dimension D40*g*5 (such as for example 77 mm), notch aperture dimension D40*g*6 (such as for example 77 mm), spacing dimension D40*g*3*a*, and spacing dimension D40*g*3*b*.

In implementations forklift blade access cutout aperture 40*h*1 includes access aperture dimension D40*h*1, (such as for example 82 mm), access aperture dimension D40*h*2 (such as for example 82 mm), spacing dimension D40*h*1*a*, and spacing dimension D40*h*1*b*. In implementations forklift blade access cutout aperture 40*h*2 includes access aperture dimension D40*h*3 (such as for example 86 mm), access aperture dimension D40*h*4 (such as for example 86 mm), spacing dimension D40*h*2*a*, and spacing dimension D40*h*2*b*. In implementations forklift blade access cutout aperture 40*h*3 includes access aperture dimension D40*h*5 (such as for example 90 mm), and access aperture dimension D40*h*6 (such as for example 90 mm), spacing dimension D40*h*3*a*, and spacing dimension D40*h*3*b*.

Figure 10C:
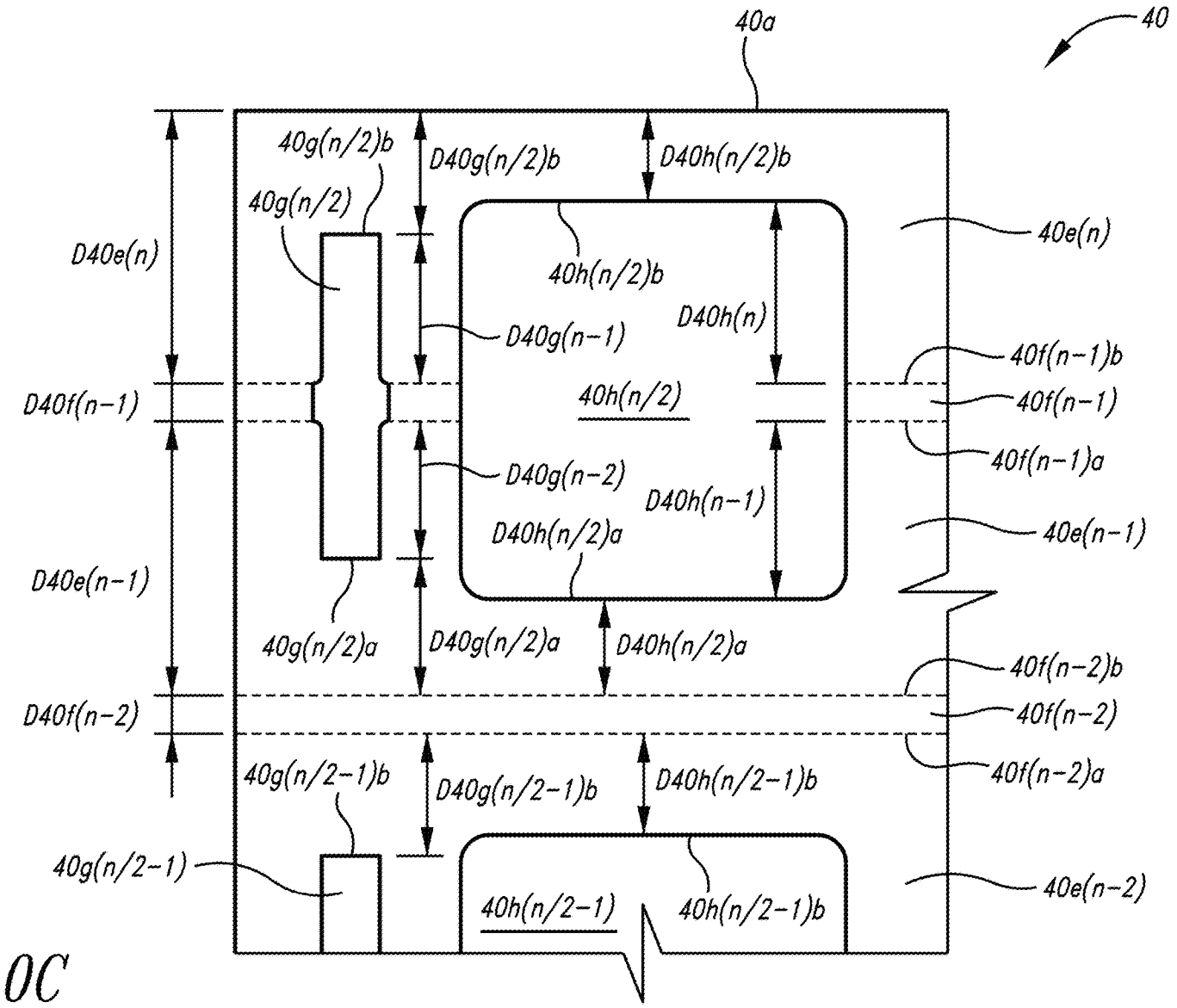
FIG. 10C is a top plan view of a portion of an abstracted version of the unfolded configured lower sheet of FIG. 9.

Turning to FIG. 10C, depicted therein is a top plan view of a portion of an abstracted version of configured upper cardboard sheet 40. In implementations configured upper cardboard sheet 40 includes segment portion 40*e*(n−2), segment portion 40*e*(n−1), and segment portion 40*e*(n). In implementations configured upper cardboard sheet 40 includes demarcated bend line pair 40*f*(n−2) with demarcated bend line 40*f*(n−2)a, and demarcated bend line 40*f*(n−2)b. In implementations configured upper cardboard sheet 40 includes demarcated bend line pair 40*f*(n−1) with demarcated bend line 40*f*(n−1)a, and demarcated bend line 40*f*(n−1)b. In implementations configured upper cardboard sheet 40 includes engagement notch aperture 40*g*(n/2−1) with notch aperture side 40*g*(n/2−1)b. In implementations configured upper cardboard sheet 40 includes engagement notch aperture 40*g*(n/2) with notch aperture side 40*g*(n/2)a, and notch aperture side 40*g*(n/2)b.

In implementations configured upper cardboard sheet 40 includes forklift blade access cutout aperture 40*h*(n/2−1) with access aperture side 40*h*(n/2−1)b. In implementations configured upper cardboard sheet 40 includes forklift blade access cutout aperture 40*h*(n/2) with access aperture side 40*h*(n/2)a, and access aperture side 40*h*(n/2)b. In implementations configured upper cardboard sheet 40 includes segment dimension D40*e*(n−1), and segment dimension D40*e*(n). In implementations configured upper cardboard sheet 40 includes bend line pair dimension D40*f*(n−2), and bend line pair dimension D40*f*(n−1). In implementations engagement notch aperture 40*g*(n/2−1) includes D40*g*(n/2−1). In implementations engagement notch aperture 40*g*(n/2) includes notch aperture dimension D40*g*(n−2), notch aperture dimension D40*g*(n−1), spacing dimension D40*g*(n/2)a, and spacing dimension D40*g*(n/2)b. In implementations configured upper cardboard sheet 40 includes spacing dimension D40*h*(n/2−1) b, spacing dimension D40*h*(n/2)a, spacing dimension D40*h*(n/2)b, access aperture dimension D40*h*(n−1), and access aperture dimension D40*h*(n).

Figure 11:
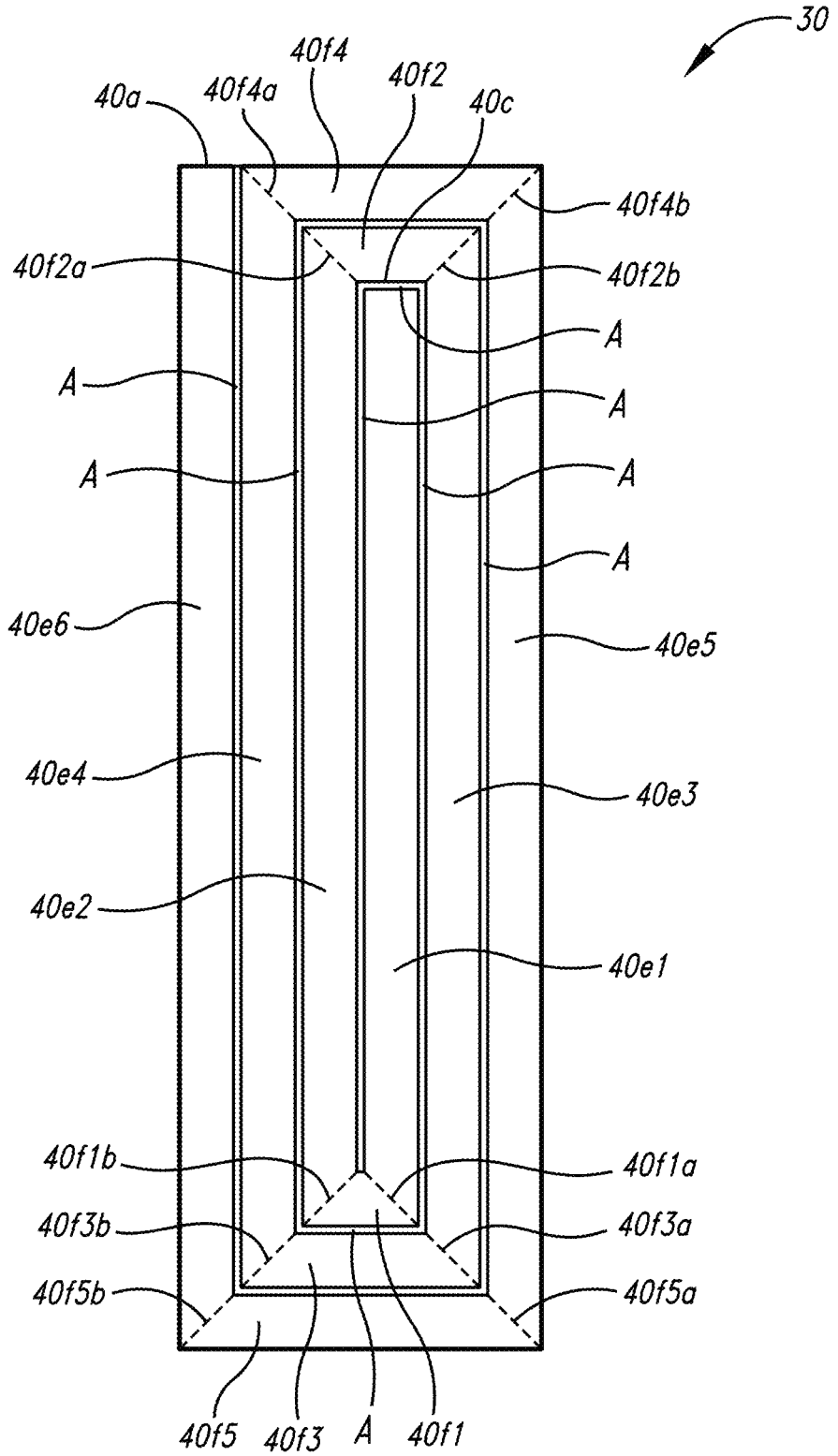
FIG. 11 is an side elevation end view of the upper beam member of FIG. 8.

Turning to FIG. 11, depicted therein is an side elevation end view of upper beam member 30.

Figure 12:
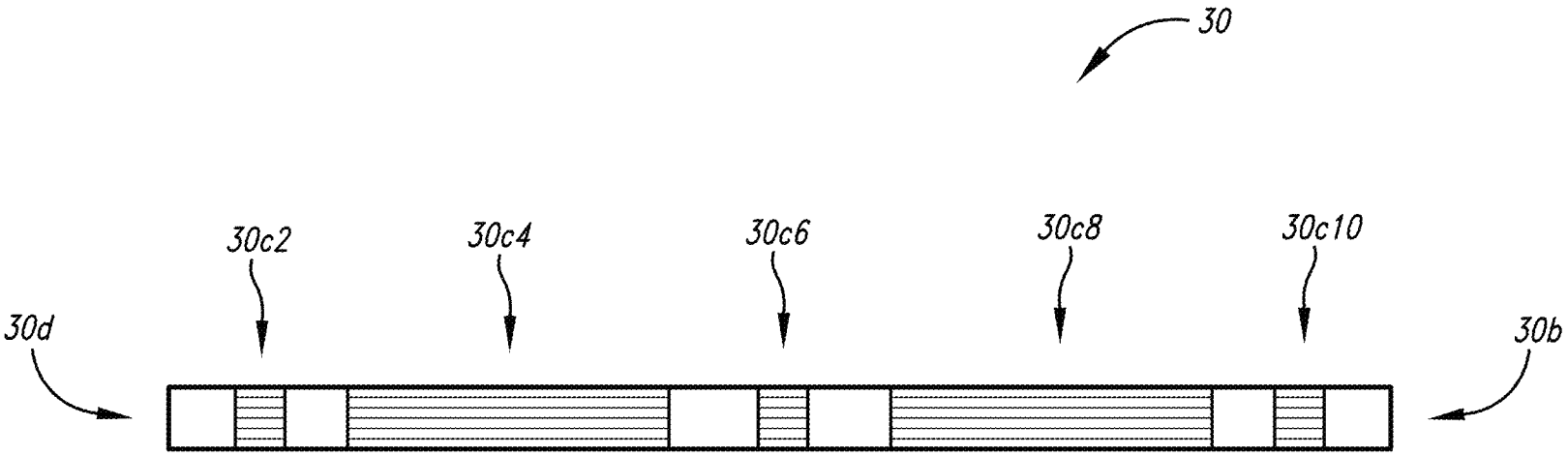
FIG. 12 is a bottom plan view of the upper beam member of FIG. 8.

Turning to FIG. 12, depicted therein is a bottom plan view of upper beam member 30.

Figure 13:
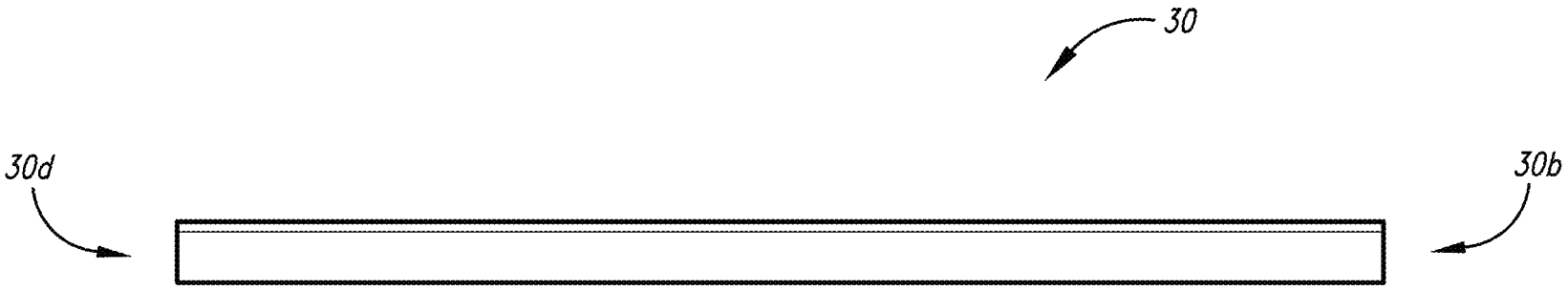
FIG. 13 is a top plan view of the upper beam member of FIG. 8.

Turning to FIG. 13, depicted therein is a top plan view of upper beam member 30.

Figure 14:
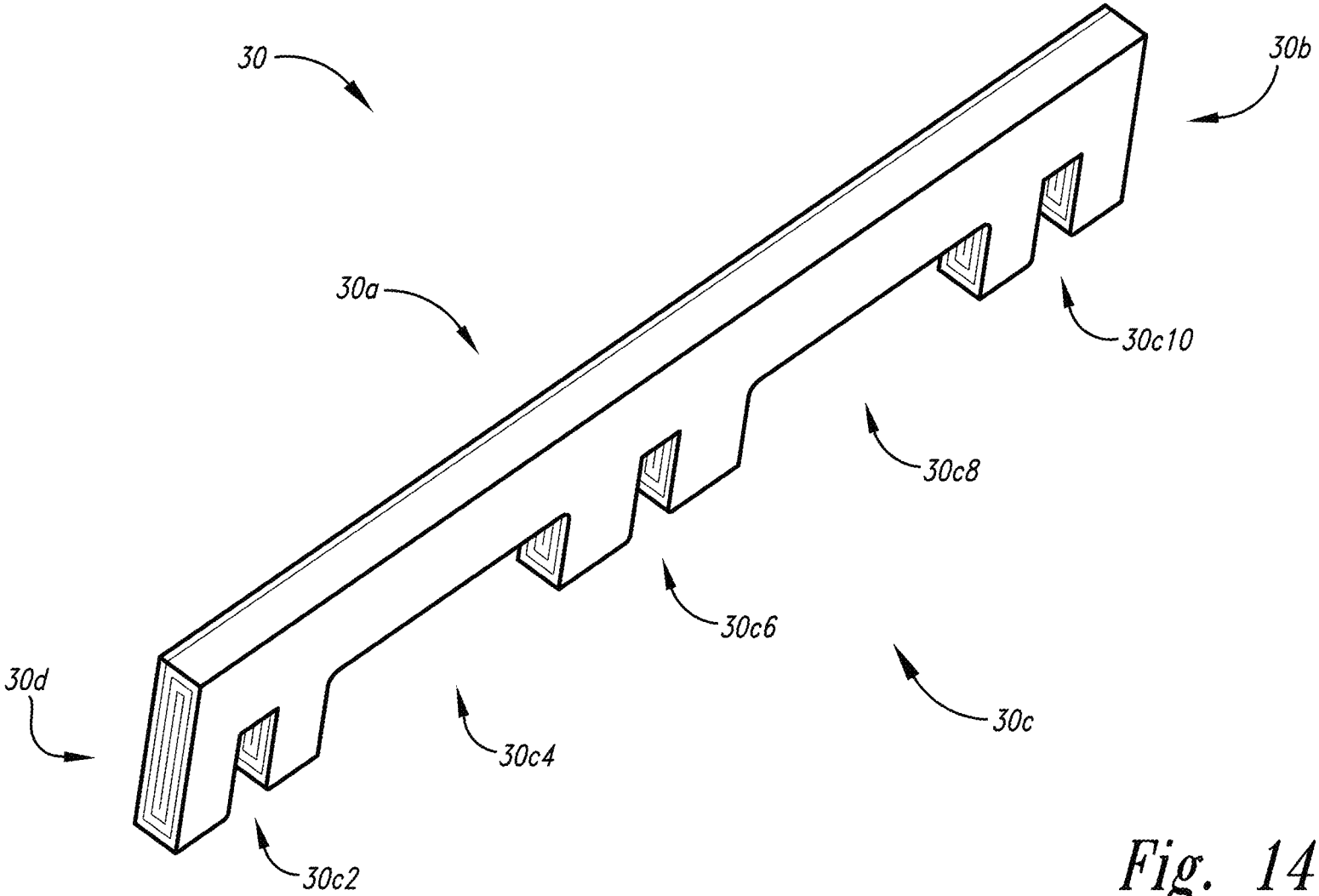
FIG. 14 is a perspective view of the upper beam member of FIG. 8.

Turning to FIG. 14, depicted therein is a perspective view of upper beam member 30.

Figure 15:
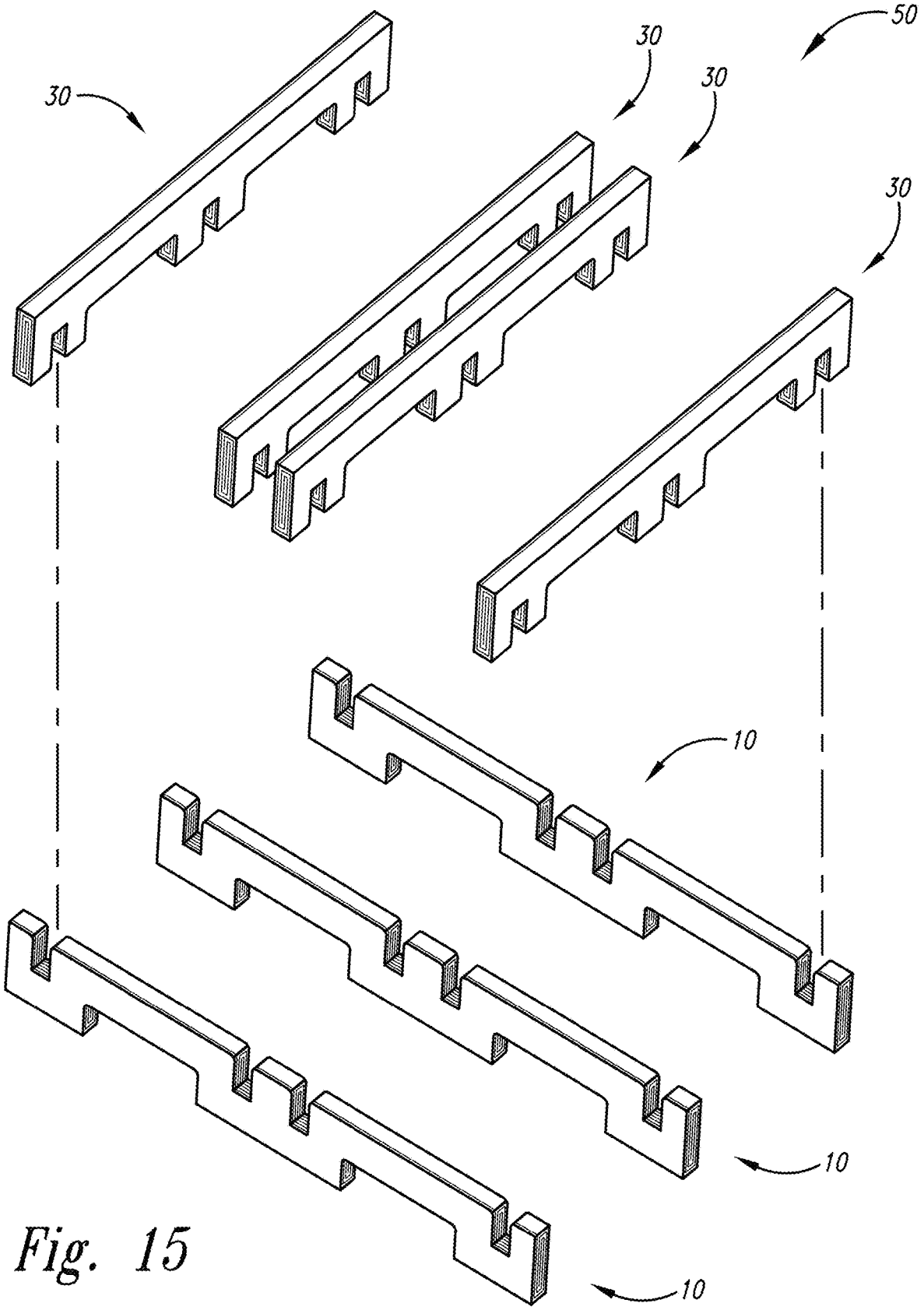
FIG. 15 is an exploded perspective view of a beam assembly.

Turning to FIG. 15, depicted therein is an exploded perspective view of pallet base assembly 50, implementations of which can varying number of lower beam member 10 and upper beam member 30 depending upon loading requirements such as for an eight ton static load.

Figure 16:
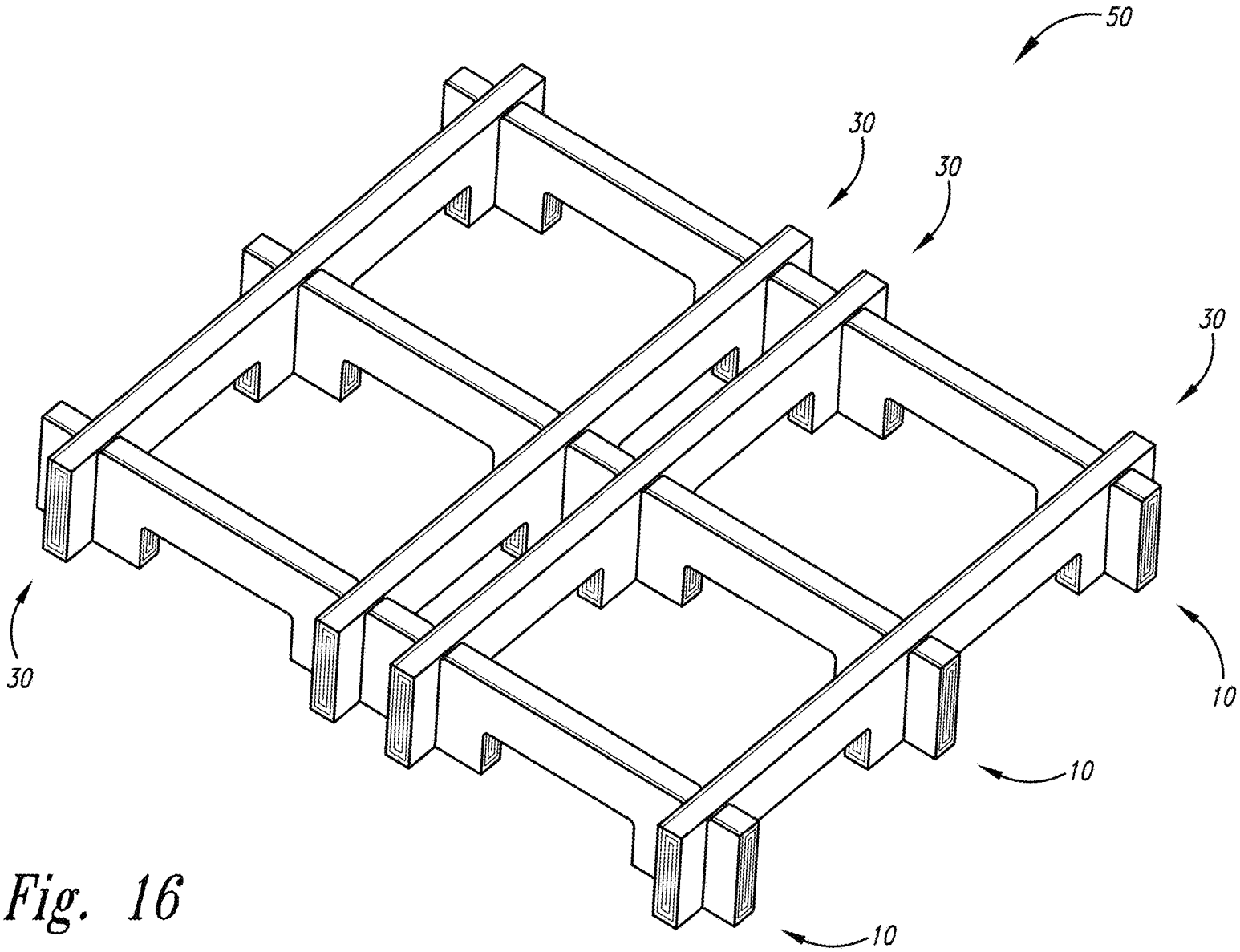
FIG. 16 is a perspective view of the beam assembly of FIG. 15.

Turning to FIG. 16, depicted therein is a perspective view of pallet base assembly 50.

Figure 17:
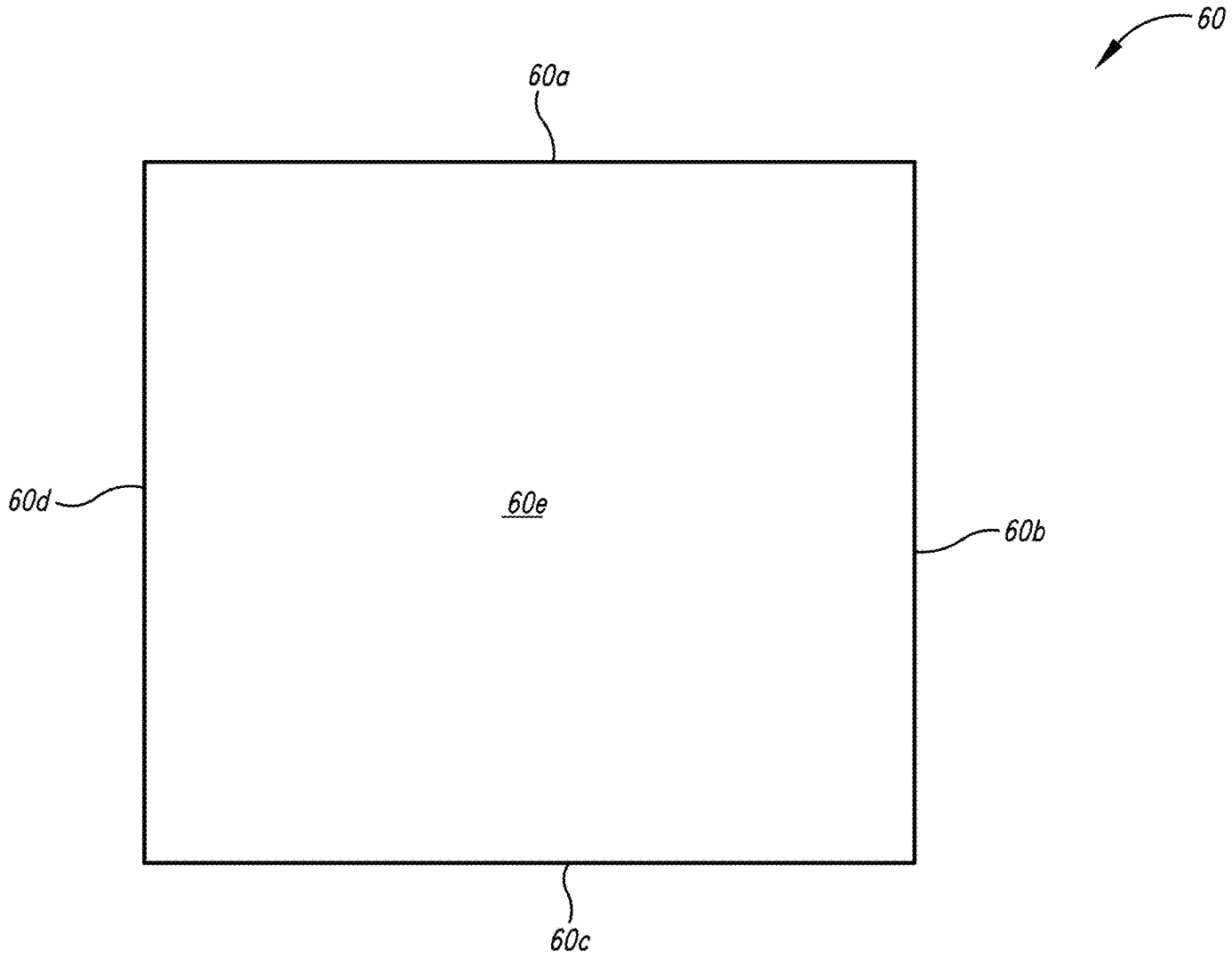
FIG. 17 is a top plan view of a platform member.

Turning to FIG. 17, depicted therein is a top plan view of platform member 60. In implementations platform member 60 includes platform side 60*a*, platform side 60*b*, platform side 60*c*, platform side 60*d*, and platform base 60*e*.

Figure 18:
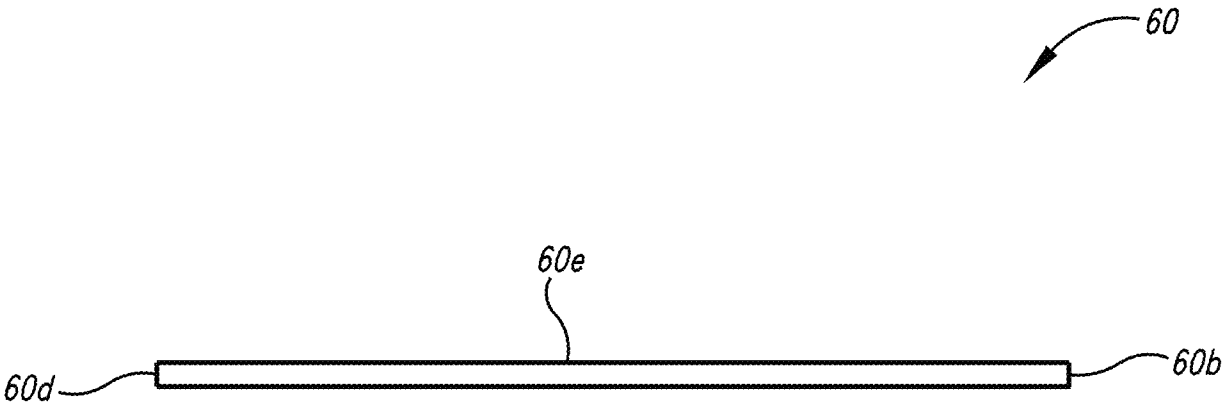
FIG. 18 is a side elevational view of the platform member of FIG. 17.

Turning to FIG. 18, depicted therein is a side elevational view of platform member 60.

Figure 19:
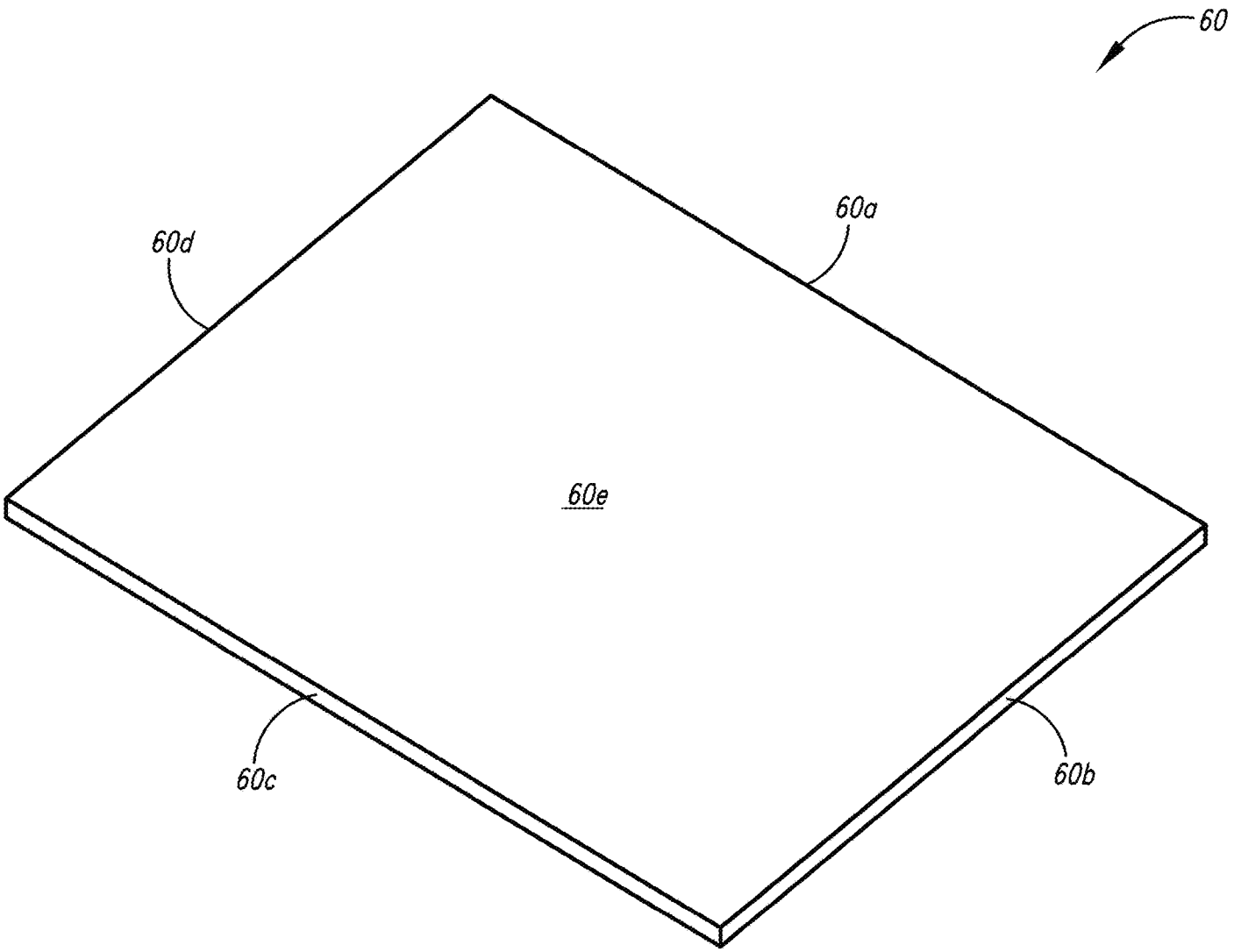
FIG. 19 is a perspective view of the platform member of FIG. 17.

Turning to FIG. 19, depicted therein is a perspective view of platform member 60.

Figure 20:
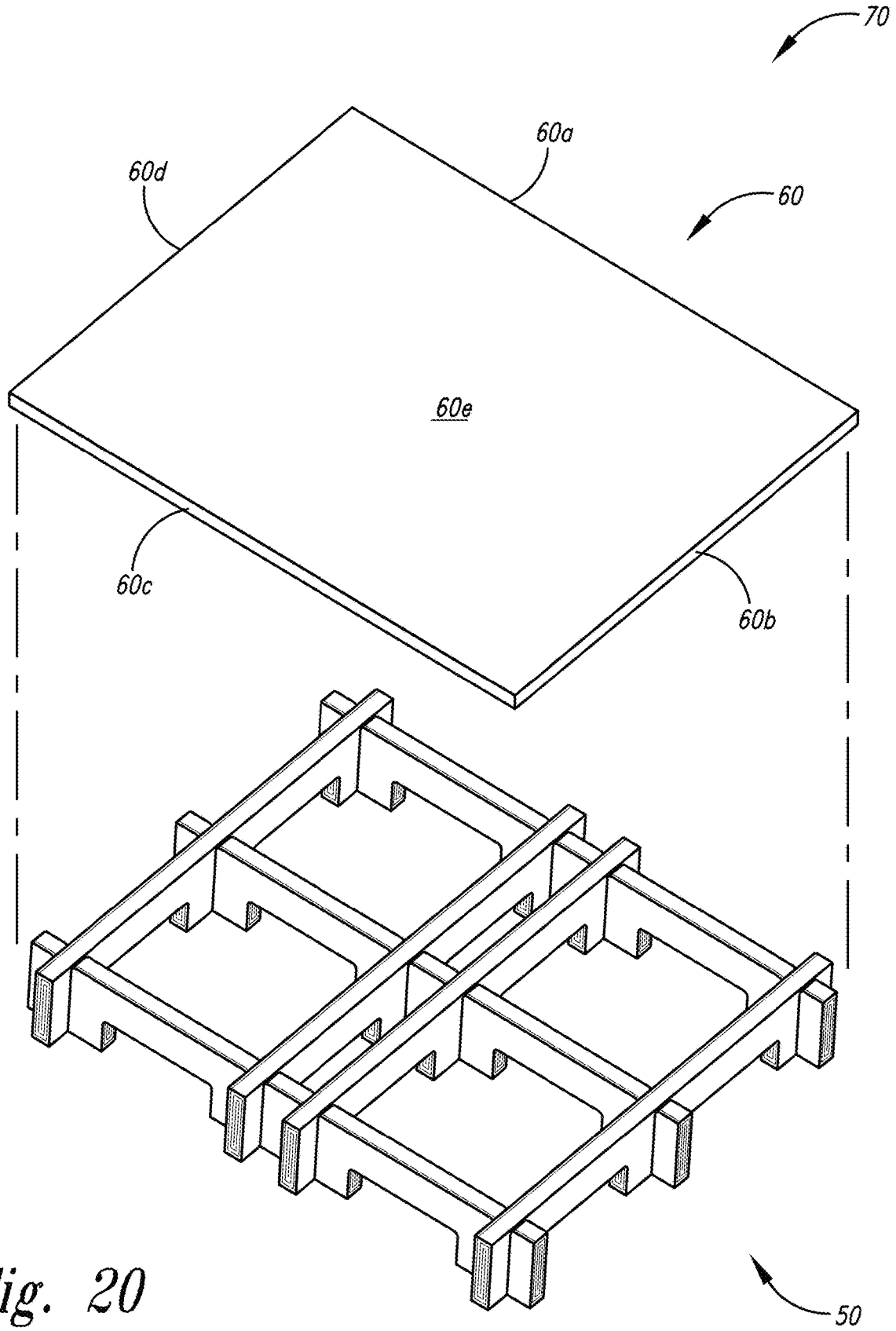
FIG. 20 is an exploded perspective view of a pallet assembly.

Turning to FIG. 20, depicted therein is an exploded perspective view of pallet assembly 70.

Figure 21:
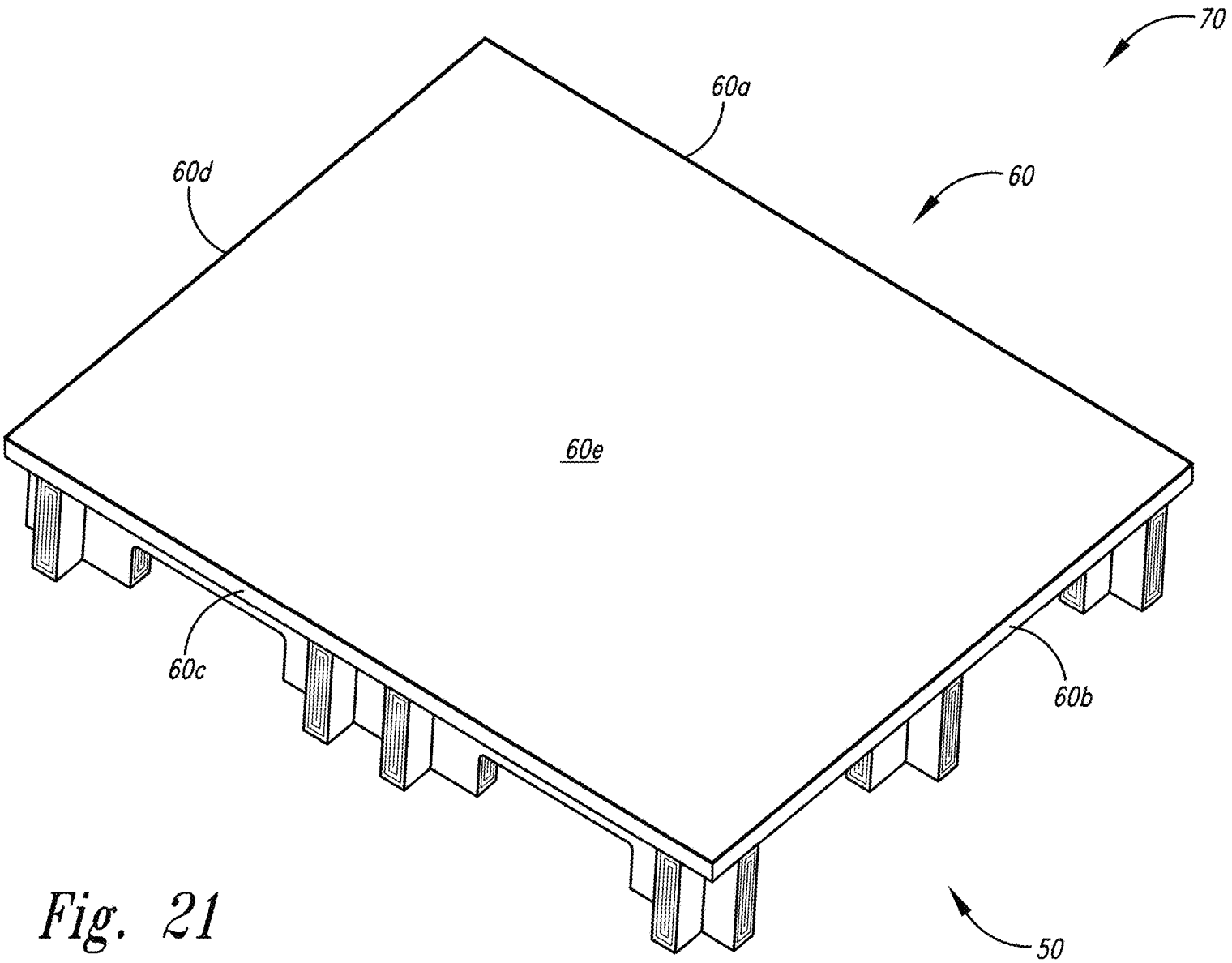
FIG. 21 is a perspective view of the pallet assembly of FIG. 20.

Turning to FIG. 21, depicted therein is a perspective view of pallet assembly 70.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A pallet system comprising:

(I) a first cardboard sheet having a first sheet thickness measurement, the first cardboard sheet including (A) a first sheet side, (B) a second sheet side extending perpendicularly to the first side, (C) a third sheet side extending parallel to the first side, (D) a fourth sheet side extending parallel to the second side, and (E) a plurality of demarcated bend lines extending parallel to the first sheet side and to the third sheet side, wherein each of the plurality of demarcated bend lines extends between the second sheet side and the fourth sheet side, wherein the plurality of demarcated bend lines includes a first demarcated bend line, a second demarcated bend line, a third demarcated bend line, a fourth demarcated bend line, a fifth demarcated bend line, a sixth demarcated bend line, and a seventh demarcated bend line, wherein the first demarcated bend line is closest of the plurality of demarcated bend lines to the third sheet side and is at least ten times the first sheet thickness measurement from the third sheet side, wherein the second demarcated bend line is second closest of the plurality of demarcated bend lines to the third sheet side and is less than three times the first sheet thickness measurement from the first demarcated bend line;

wherein the third demarcated bend line is third closest of the plurality of demarcated bend lines to the third sheet side and is at least twenty-five times the first sheet thickness measurement from the third sheet side, wherein the fourth demarcated bend line is fourth closest of the plurality of demarcated bend lines to the third sheet side being less than five times the first sheet thickness measurement from the third demarcated bend line and being farther from the third demarcated bend line than the second demarcated bend line is from the first demarcated bend line, wherein the first cardboard sheet is bent at each of the plurality of demarcated bend lines thereby forming a plurality of cardboard sheet segment portions positioned parallel with one another including a first cardboard sheet segment portion bordered by the third sheet side and bordered by the first demarcated bend line, a second cardboard sheet segment portion bordered by the second demarcated bend line and the third demarcated bend line, a third cardboard sheet segment portion bordered by the fourth demarcated bend line and bordered by the fifth demarcated bend line, a fourth cardboard sheet segment portion bordered by the sixth demarcated bend line and bordered by the seventh demarcated bend line, whereby the first cardboard sheet is bent such that the first cardboard sheet segment portion is adhesively coupled and positioned adjacent to the second cardboard sheet segment portion with adhesive positioned between the first cardboard sheet segment portion and the second cardboard sheet segment portion, whereby the first cardboard sheet is bent such that the first cardboard sheet segment portion is adhesively coupled with and positioned adjacent to the third cardboard sheet segment portion with adhesive positioned between the first cardboard sheet segment portion and the third cardboard sheet segment portion, whereby the first cardboard sheet is bent such that the second cardboard sheet segment portion is adhesively coupled with and positioned adjacent to the fourth cardboard sheet segment portion with adhesive positioned between the second cardboard sheet segment portion and the fourth cardboard sheet segment portion, and whereby the first cardboard sheet is bent such that cardboard sheet segment portions form a spiral configuration having an innermost central portion to include the first cardboard segment portion and the second cardboard segment portion.

2. The system of claim 1, further including a first plurality of apertures with first and third side portions extending parallel with the first sheet side, and with second and fourth side portions extending parallel with the second sheet side, wherein the first plurality of apertures includes a first aperture, and a second aperture, wherein the first and third side portions of the first aperture are equal to the first and third side portions of the second aperture, respectively, and wherein the fourth side portion of the first aperture and the fourth side portion of the second aperture are equally spaced from the fourth sheet side.

3. The system of claim 2, wherein a first portion of the second side portion of the first aperture extends a first length perpendicularly from the first demarcated bend line to the third side portion of the first aperture, wherein a second portion of the second side portion of the first aperture extends a second length perpendicularly from the second demarcated bend line to the first side portion of the first aperture, and wherein the first length equals the second length.

4. The system of claim 2, wherein the first and third side portions of the first plurality of apertures have lengths at least twenty times the first sheet thickness measurement, and wherein the second and fourth side portions of the first plurality of apertures have lengths at least ten times the first sheet thickness measurement.

5. The system of claim 2, wherein the second and fourth side portions of the first aperture are smaller than the second and fourth side portions of the second aperture, respectively.

6. The system of claim 2, wherein the first plurality of apertures includes a third aperture, and a fourth aperture, wherein the first and third side portions of the third aperture are equal to the first and third side portions of the fourth aperture, respectively, wherein the fourth side portion of the third aperture and the fourth side portion of the fourth aperture are equally spaced from the fourth sheet side, wherein the fourth side portion of the third aperture and the fourth side portion of the second aperture are unequally spaced from the fourth sheet side, wherein the third side portions of the first aperture and the third aperture are equally spaced from the third sheet side, and wherein the third side portions of the second aperture and the fourth aperture are equally spaced from the third sheet side.

7. The system of claim 2, further including a second plurality of apertures with first and third side portions extending parallel with the first sheet side, and with second and fourth side portions extending parallel with the second sheet side, wherein the second plurality of apertures includes a first aperture and a second aperture, wherein the first and third side portions of the first aperture of the second plurality of apertures are equal to the first and third side portions of the second aperture of the second plurality of apertures, respectively, wherein the first and third side portions of the first aperture of the second plurality of apertures are not equal to the first and third side portions of the first aperture of the first plurality of apertures, respectively, wherein the second and fourth side portions of the first aperture of the second plurality of apertures are not equal to the second and fourth side portions of the first aperture of the first plurality of apertures, respectively, wherein the third side portion of the first aperture of the second plurality of apertures and the third side portion of the second aperture of the second plurality of apertures are unequally spaced from the third sheet side, and wherein the fourth side portion of the first aperture of the second plurality of apertures and the fourth side portion of the second aperture of the second plurality of apertures are equally spaced from the fourth sheet side.

8. The system of claim 7, wherein a first portion of the second side portion of the first aperture of the second plurality of apertures extends a first length perpendicularly from the third demarcated bend line to the third side portion of the first aperture of the second plurality of apertures, wherein a second portion of the second side portion of the first aperture extends a second length perpendicularly from the fourth demarcated bend line to the first side portion of the first aperture of the second plurality of apertures, and wherein the first length equals the second length.

9. The system of claim 7, wherein the first and third side portions of the second plurality of apertures have lengths at least four times the first sheet thickness measurement, and wherein the second and fourth side portions of the second plurality of apertures have lengths at least ten times the first sheet thickness measurement.

10. The system of claim 7, wherein the second and fourth side portions of the first aperture of the second plurality of apertures are smaller than the second and fourth side portions of the second aperture of the second plurality of apertures, respectively.

11. The system of claim 7, further including a plurality of square-notch portions with first side portions extending parallel with the first sheet side, and with second and third side portions extending parallel with the second sheet side, wherein at least one of the plurality of square-notch portions has the second and third side portions extending from the first sheet side, and wherein at least one of the plurality of square-notch portions has the second and third side portions extending from the third sheet side.

12. The system of claim 1, further including (II) a second cardboard sheet having a second sheet thickness measurement, the second cardboard sheet including (A) a first sheet side, (B) a second sheet side extending perpendicularly to the first side, (C) a third sheet side extending parallel to the first side, (D) a fourth sheet side extending parallel to the second side, and (E) a plurality of demarcated bend lines extending parallel to the first sheet side and to the third sheet side, (F) a first plurality of apertures with first and third side portions extending parallel to the third sheet side, and with second and fourth side portions extending parallel to the second sheet side, (G) a second plurality of apertures with first and third side portions extending parallel to the third sheet side, and with second and fourth side portions extending parallel to the second sheet side, wherein the first and third side portions of the first plurality of apertures have a first length, wherein the first and third side portions of the second plurality of apertures have a second length, wherein the first length does not equal the second length, wherein each of the plurality of demarcated bend lines extends between the second sheet side and the fourth sheet side, wherein the plurality of demarcated bend lines includes a first demarcated bend line, and a second demarcated bend line, wherein the first demarcated bend line is closest of the plurality of demarcated bend lines to the third sheet side, and wherein the second demarcated bend line is second closest of the plurality of demarcated bend lines to the third sheet side.

13. The system of claim 12, wherein a first portion of the second side portion of a first aperture of the first plurality of apertures of the second cardboard sheet extends a first length perpendicularly from the first demarcated bend line of the second cardboard sheet to the third side portion of the first aperture of the first plurality of apertures of the second cardboard sheet, wherein a second portion of the second side portion of the first aperture of the first plurality of apertures of the second cardboard sheet extends a second length perpendicularly from the second demarcated bend line of the second cardboard sheet to the first side portion of the first aperture of the first plurality of apertures of the second cardboard sheet, wherein the first length equals the second length, wherein a first portion of the second side portion of a first aperture of the second plurality of apertures of the second cardboard sheet extends a third length perpendicularly from the first demarcated bend line to the third side portion of the first aperture of the second plurality of apertures of the second cardboard sheet, wherein a second portion of the second side portion of the first aperture of the second plurality of apertures of the second cardboard sheet extends a fourth length perpendicularly from the second demarcated bend line to the first side portion of the first aperture of the second plurality of apertures of the second cardboard sheet, wherein the third length equals the fourth length, and wherein the first length is unequal to the third length.

14. The system of claim 1, wherein the plurality of demarcated bend lines totals an "n" numbered amount, wherein the "n" number is an even number, wherein the first cardboard sheet is bent at each of the plurality of demarcated bend lines such that "n+1" cardboard sheet portions are positioned parallel with one another including a first cardboard sheet portion bordered by the third sheet side and bordered by the first demarcated bend line, a second cardboard sheet portion bordered by the second demarcated bend line and bordered by the third demarcated bend line, and an "n+1" cardboard sheet portion bordered by a demarcated bend line closest to the first sheet side and bordered by the first sheet side, whereby the first cardboard sheet forms a first longitudinal beam member having first and second longitudinal sides and having first and second ends perpendicular to the first and second longitudinal sides, and wherein the first longitudinal beam member includes at least one engagement notch along the first longitudinal side.

15. The system of claim 14, wherein the first longitudinal beam member includes the at least one forklift blade access cutout along the second longitudinal side, and wherein the plurality of demarcated bend lines include at least one form taken from the forms of perforated lines, creased lines, and printed lines.

16. The system of claim 14, wherein the first longitudinal beam member includes the at least one forklift blade access cutout along the first longitudinal side, and wherein the plurality of demarcated bend lines include at least one form taken from the following forms of perforated lines, creased lines, and printed lines.

17. The system of claim 1, wherein the first cardboard sheet is bent at each of the plurality of demarcated bend lines to form a first longitudinal beam member having first and second longitudinal sides and having first and second ends perpendicular to the first and second longitudinal sides, wherein the first longitudinal beam member includes at least one engagement notch along the first longitudinal side, and wherein the first longitudinal beam member includes at least one forklift blade access cutout along the second longitudinal side.

18. The system of claim 17, further including a second cardboard sheet, wherein the second cardboard sheet includes a plurality of demarcated bend lines, wherein the second cardboard sheet is bent at each of the demarcated bend lines to form a second longitudinal beam member having first and second longitudinal sides and having first and second ends perpendicular to the first and second longitudinal sides, wherein the second longitudinal beam member includes at least one engagement notch along the first longitudinal side, wherein the second longitudinal beam member includes at least one forklift blade access cutout along the first longitudinal side, wherein the at least one engagement notch of the second longitudinal beam member is couplable with the at least one engagement notch of the first longitudinal beam.

19. A pallet system comprising:

(I) a bent cardboard sheet having a sheet thickness measurement, the first cardboard sheet including (A) a first sheet side, (B) a second sheet side extending perpendicularly to the first side, (C) a third sheet side extending parallel to the first side, (D) a fourth sheet side extending parallel to the second side, (E) a first plurality of apertures having rectangularly oriented side portions, (F) a second plurality of apertures having rectangularly oriented side portions, wherein the side portions of the first plurality of apertures are proportionally shaped different than the side portions of the second plurality of apertures, and (F) a plurality of demarcated bend line pairs extending parallel to the first sheet side and to the third sheet side, each of the plurality of demarcated bend line pairs including a first demarcated bend line and a second demarcated bend line, wherein each of the plurality of demarcated bend line pairs extends between the second sheet side and the fourth sheet side, wherein the first and second demarcated bend lines of each of the plurality of demarcated bend line pairs are spaced from one another according to the sheet thickness measurement, wherein the plurality of demarcated bend line pairs includes a first demarcated bend line pair closest to the third sheet side, a second demarcated bend line pair second closest to the third sheet side, a third demarcated bend line pair third closest to the third sheet side, a fourth demarcated bend line pair fourth closest to the third sheet side, and wherein the plurality of demarcated bend line pairs totals an "n" numbered amount, wherein the bent cardboard sheet is bent at each of the plurality of demarcated bend lines such that "n+1" cardboard sheet segment portions are positioned parallel with one another including a first cardboard sheet segment portion bordered by the third sheet side and bordered by the first demarcated bend line of the first demarcated bend line pair, a second cardboard sheet segment portion bordered by the second demarcated bend line of the first demarcated bend line pair and bordered by the third first demarcated bend line of the second demarcated bend line pair, a third cardboard sheet segment portion bordered by the second demarcated bend line of the second demarcated bend line pair and bordered by the first demarcated bend line of the third demarcated bend line pair, a fourth cardboard sheet segment portion bordered by the second demarcated bend line of the third demarcated bend line pair and bordered by the first demarcated bend line of the fourth demarcated bend line pair, and an "n+1" cardboard sheet segment portion bordered by a demarcated bend line of a demarcated bend line pair closest to the first sheet side and bordered by the first sheet side, whereby the bent cardboard sheet includes the first cardboard sheet segment portion adhesively coupled and positioned adjacent to the second cardboard sheet segment portion with adhesive positioned between the first cardboard sheet segment portion and the second cardboard sheet segment portion, whereby the bent cardboard sheet includes the first cardboard sheet segment portion adhesively coupled with and positioned adjacent to the third cardboard sheet segment portion with adhesive positioned between the first cardboard sheet segment portion and the third cardboard sheet segment portion, whereby the bent cardboard sheet includes the second cardboard sheet segment portion adhesively coupled with and positioned adjacent to the fourth cardboard sheet segment portion with adhesive positioned between the second cardboard sheet segment portion and the fourth cardboard sheet segment portion, whereby the bent cardboard sheet forms a first longitudinal beam member having first and second longitudinal sides and having first and second ends perpendicular to the first and second longitudinal sides, wherein the first longitudinal beam member includes at least one engagement notch formed from at least in part the first plurality of apertures along the first longitudinal side, wherein the first longitudinal beam member includes at least one forklift blade access cutout formed at least in part from the second plurality of apertures along one of the first longitudinal side and the second longitudinal side, and whereby the first cardboard sheet is bent such that cardboard sheet segment portions form a spiral configuration having a contiguous central spiral region to include the first cardboard segment portion.

20. A pallet system comprising:

(I) a first bent cardboard sheet including (A) a plurality of cardboard sheet segment portions, (B) a first plurality of apertures, (C) a second plurality of apertures, wherein the first bent cardboard sheet has a plurality of bends such that the plurality of cardboard sheet segment portions are in juxtaposition and with adhesive positioned therebetween, wherein the first bent cardboard sheet is bent such that cardboard sheet segment portions form a spiral configuration to include a first cardboard segment portion, a second cardboard segment portion, a third cardboard segment portion, and a forth cardboard segment portion positioned parallel therewith, wherein the first bent cardboard sheet is bent such that the first cardboard sheet segment portion is adhesively coupled and positioned adjacent to the second cardboard sheet segment portion with adhesive positioned between the first cardboard sheet segment portion and the second cardboard sheet segment portion, wherein the first bent cardboard sheet is bent such that the first cardboard sheet segment portion is adhesively coupled with and positioned adjacent to the third cardboard sheet segment portion with adhesive positioned between the first cardboard sheet segment portion and the third cardboard sheet segment portion, wherein the first bent cardboard sheet is bent such that the second cardboard sheet segment portion is adhesively coupled with and positioned adjacent to the fourth cardboard sheet segment portion with adhesive positioned between the second cardboard sheet segment portion and the fourth cardboard sheet segment portion, and wherein the first bent cardboard sheet is bent such that cardboard sheet segment portions form the spiral configuration having an innermost central portion to include the first cardboard segment portion without one or more voids being present with the innermost central portion, whereby the first bent cardboard sheet forms a first longitudinal beam member having first and second longitudinal sides, wherein the first longitudinal beam member includes at least one engagement notch formed from at least in part the first plurality of apertures along the first longitudinal side, and wherein the first longitudinal beam member includes at least one forklift blade access cutout formed at least in part from the second plurality of apertures along the second longitudinal side; and (II) a second bent cardboard sheet including (A) a plurality of cardboard sheet segment portions, (B) a first plurality of apertures, (C) a second plurality of apertures, wherein the second bent cardboard sheet has a plurality of bends such that the plurality of cardboard sheet segment portions are in juxtaposition and with adhesive positioned therebetween, wherein the second bent cardboard sheet is bent such that cardboard sheet segment portions form a spiral configuration to include a first cardboard segment portion, a second cardboard segment portion, a third cardboard segment portion, and a forth cardboard segment portion positioned parallel therewith, wherein the second bent cardboard sheet is bent such that the first cardboard sheet segment portion is adhesively coupled and positioned adjacent to the second cardboard sheet segment portion with adhesive positioned between the first cardboard sheet segment portion and the second cardboard sheet segment portion, wherein the second bent cardboard sheet is bent such that the first cardboard sheet segment portion is adhesively coupled with and positioned adjacent to the third cardboard sheet segment portion with adhesive positioned between the first cardboard sheet segment portion and the third cardboard sheet segment portion, wherein the second bent cardboard sheet is bent such that the second cardboard sheet segment portion is adhesively coupled with and positioned adjacent to the fourth cardboard sheet segment portion with adhesive positioned between the second cardboard sheet segment portion and the fourth cardboard sheet segment portion, and wherein the second bent cardboard sheet is bent such that cardboard sheet segment portions form the spiral configuration having an innermost central portion to include the first cardboard segment portion without one or more voids being present within the spiral configuration, whereby the second bent cardboard sheet forms a second longitudinal beam member having first and second longitudinal sides, wherein the second longitudinal beam member includes at least one engagement notch formed from at least in part the first plurality of apertures along the first longitudinal side, wherein the second longitudinal beam member includes at least one forklift blade access cutout formed at least in part from the second plurality of apertures along the first longitudinal side, and wherein the at least one engagement notch of the first longitudinal beam member is couplable with the at least one engagement notch of the second longitudinal beam member.

* * * * *